US011454906B2

(12) United States Patent
Shima

(10) Patent No.: US 11,454,906 B2
(45) Date of Patent: Sep. 27, 2022

(54) IMAGE FORMING APPARATUS WITH BEARING MEMBERS FOR TRANSFER ROLLER

(71) Applicant: CANON KABUSHIKI KAISHA, Tokyo (JP)

(72) Inventor: Toshihide Shima, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/390,191

(22) Filed: Jul. 30, 2021

(65) Prior Publication Data

US 2022/0043372 A1 Feb. 10, 2022

(30) Foreign Application Priority Data

Aug. 4, 2020 (JP) ..... JP2020-132716

(51) Int. Cl.
*G03G 15/16* (2006.01)
*G03G 21/16* (2006.01)

(52) U.S. Cl.
CPC ..... *G03G 15/1615* (2013.01); *G03G 21/168* (2013.01); *G03G 21/1647* (2013.01)

(58) Field of Classification Search
CPC ..... G03G 15/1605; G03G 15/1615; G03G 21/1647; G03G 21/168; G03G 2221/1642
See application file for complete search history.

(56) References Cited

U.S. PATENT DOCUMENTS

2010/0142997 A1* 6/2010 Kaneyama ..... G03G 15/1605 399/121
2020/0209785 A1* 7/2020 Matsuzaki ..... G03G 15/161

FOREIGN PATENT DOCUMENTS

JP 2005-316200 A 11/2005

* cited by examiner

*Primary Examiner* — Sophia S Chen
(74) *Attorney, Agent, or Firm* — Venable LLP

(57) ABSTRACT

An image forming apparatus includes an image bearing member, an intermediary transfer belt, a transfer roller, and a metallic roller in contact with the transfer roller to form a current path through which a current flows between itself and the transfer roller. The apparatus further includes a first bearing member to rotatably support the transfer roller, a holding member to movably hold the first bearing member, a first pressing member to press the first bearing member, a second bearing member movably held by the first bearing member and to rotatably support the metallic roller and a second pressing member provided between a bearing surface provided in the first bearing member and the second bearing member to press the second bearing member.

9 Claims, 11 Drawing Sheets

COMP. 1

COMP. 2

(b)

(a)

(b)

(a)

IMAGE FORMING APPARATUS WITH BEARING MEMBERS FOR TRANSFER ROLLER

FIELD OF THE INVENTION AND RELATED ART

The present invention relates to an image forming apparatus, such as a copying machine, a printer, and a facsimile machine, which uses an electrophotographic image forming method, an electrostatic recording method, or the like. It also relates to a multifunction image forming apparatus having two or more functions of the abovementioned image forming apparatuses.

In the field of an image forming apparatus such as a copying machine which uses an electrophotographic method, for example, a transfer roller has been in use as a transferring member for transferring a toner image from a photosensitive member, as an image bearing member, onto a sheet of transfer medium such as paper. It has also been in use as a transferring member for transferring (secondary transfer) a toner image onto transfer medium from an intermediary transfer member as the second image bearing member such as an endless belt, after the transfer (first transfer) of the toner image from the photosensitive member as the first image bearing member, onto the intermediary transfer member. Hereafter, the present invention will be described with reference to the secondary transfer section of an image forming apparatus of the so-called intermediary transfer type, which has an intermediary transfer belt as an intermediary transferring member.

As a transfer roller, an elastic roller which has an elastic layer formed of an elastic substance is widely in use. The elastic layer of an elastic roller is given electrical conductivity by ion-conductive agent or the like dispersed in the elastic substance. As electric current is flowed through a transfer roller which has an elastic layer which contains ion-conductive agent, being therefore ion-conductive, the ion-conductive agent in the elastic layer is polarized, sometimes increasing the transfer roller in electrical resistance. As the transfer roller increases in electrical resistance, it sometimes becomes necessary to increase the transferring section in the absolute value of the transfer voltage to be applied to the transfer roller or the like for transfer. Increasing the transfer voltage in absolute value sometimes reduces the transfer roller or the like in life expectancy, the length of which is affected by the capacity of the high voltage circuit.

Thus, it has been proposed to supply a transfer roller with electric current from a power supply roller in order to minimize the transfer roller in the amount of the polarization which occurs to the ion-conductive agent in the transfer roller (Japanese Laid-open Patent Application No. 2005-316200). The secondary transfer section disclosed in Japanese Laid-open Patent Application No. 2005-316200 is provided with a power supply roller which rotates in contact with the peripheral surface of a transfer roller to supply the transfer roller with electric current from the power supply roller. That is, the transfer roller is supplied with transfer voltage by way of the power supply roller.

By the way, it is desired that the secondary transfer section is structured so that a power supply roller is rotated by the rotation of a transfer roller. Structuring the secondary transfer section so that a power supply roller is rotated by a transfer roller makes unnecessary the components for the drive train for the power supply roller, making it possible to reduce the secondary transfer section in component count. Therefore, it can simplify the secondary transfer section in structure, and also, reduce the secondary transfer section in cost. Further, it is not uncommon to structure the secondary transfer section so that its transfer roller also is rotated by the rotation of another roller.

Here, it is necessary that a power supply roller is reliably rotatable by the rotation of a transfer roller. If a power supply roller fails to be reliably rotated by the rotation of a transfer roller, it sometimes occurs that adherents such as toner particles accumulate on the upstream side of the interface between a transfer roller and a power supply roller. Further, as the adherents accumulate, they sometimes slip through the interface, and adhere to (soil) the back surface (opposite surface of sheet of transfer medium from surface onto which image is being transferred) of a sheet of transfer medium.

In order to ensure that a power supply roller is reliably rotated by the rotation of a transfer roller, it is necessary to keep the power supply roller pressed on the transfer roller. Further, in order to ensure that the transfer roller is reliably rotated, it is also necessary to keep the transfer roller pressed upon an intermediary transfer belt. In the past, a transfer roller was kept pressed upon an intermediary transfer belt by a preset amount (pressure regulation) of pressure generated by a spring, and also, the power supply roller was positioned (position regulation) so that the power supply roller hypothetically intrudes into the transfer roller by a preset amount.

If a transfer roller is not truly circular in cross-section, as the transfer roller rotates, the peripheral surface of the transfer roller moves toward, or away from, the axial line of the power supply roller. As the peripheral surface of the transfer roller moves in the direction to move away from the rotational axis of the power supply roller, the secondary transfer section decreases in the amount of pressure applied to the transfer roller by the power supply roller. As the secondary transfer section decreases in the amount of pressure applied to the transfer roller by the power supply roller, it sometimes occurs that the power supply roller is unsatisfactorily rotated. On the other hand, if the peripheral surface of the transfer roller moves in the direction to hypothetically intrude into the power supply roller, the secondary transfer section is increased in the amount of pressure applied to the transfer roller, which sometimes impedes the rotation of the transfer roller, which in turn reduces the secondary transfer section in the speed with which a sheet of transfer medium is conveyed by being sandwiched between the transfer roller and intermediary transfer belt. As the secondary transfer section is reduced in the speed with which a sheet of transfer medium is conveyed, the sheet becomes slower in speed than the image on the intermediary transfer belt. As a sheet of transfer medium becomes slower in speed relative to the image on the intermediary transfer belt, the image shrinks as it is transferred onto the sheet of transfer medium.

Problems such as the one described above are more apparent in a case where a metallic roller, in particular, the one which is smooth across its peripheral surface which comes into contact with a transfer roller, is employed as a power supply roller to simplify the secondary transfer section in structure and/or reduce the section in cost.

SUMMARY OF THE INVENTION

Therefore, the primary object of the present invention is to provide an image forming apparatus which is simpler in structure and lower in cost, and yet, is more stable in the rotation of its transfer roller, and the rotation of its metallic roller, which comes into contact with the transfer roller, than any conventional image forming apparatus.

According to an aspect of the present invention, there is provided an image forming apparatus comprising an image bearing member configured to bear a toner image; an intermediary transfer belt onto which the toner image formed on said image bearing member is transferred; a transfer roller configured to be rotated with rotation of said intermediary transfer belt in contact with an outer peripheral surface of said intermediary transfer belt, and to form a transfer portion to transfer the toner image borne on said intermediary transfer belt; a metallic roller in contact with said transfer roller, configured to be rotated by rotation of said transfer roller and to form a current path through which a current flows between itself and said transfer roller; a first bearing member configured to rotatably support said transfer roller; a holding member configured to movably hold said first bearing member; a first pressing member configured to press said first bearing member; a second bearing member movably held by said first bearing member and configured to rotatably support said metallic roller; and a second pressing member provided between a bearing surface provided in said first bearing member and said second bearing member, configured to press said second bearing member.

Further features of the present invention will become apparent from the following description of exemplary embodiments (with reference to the attached drawings).

DESCRIPTION OF THE EMBODIMENTS

Figure 1:
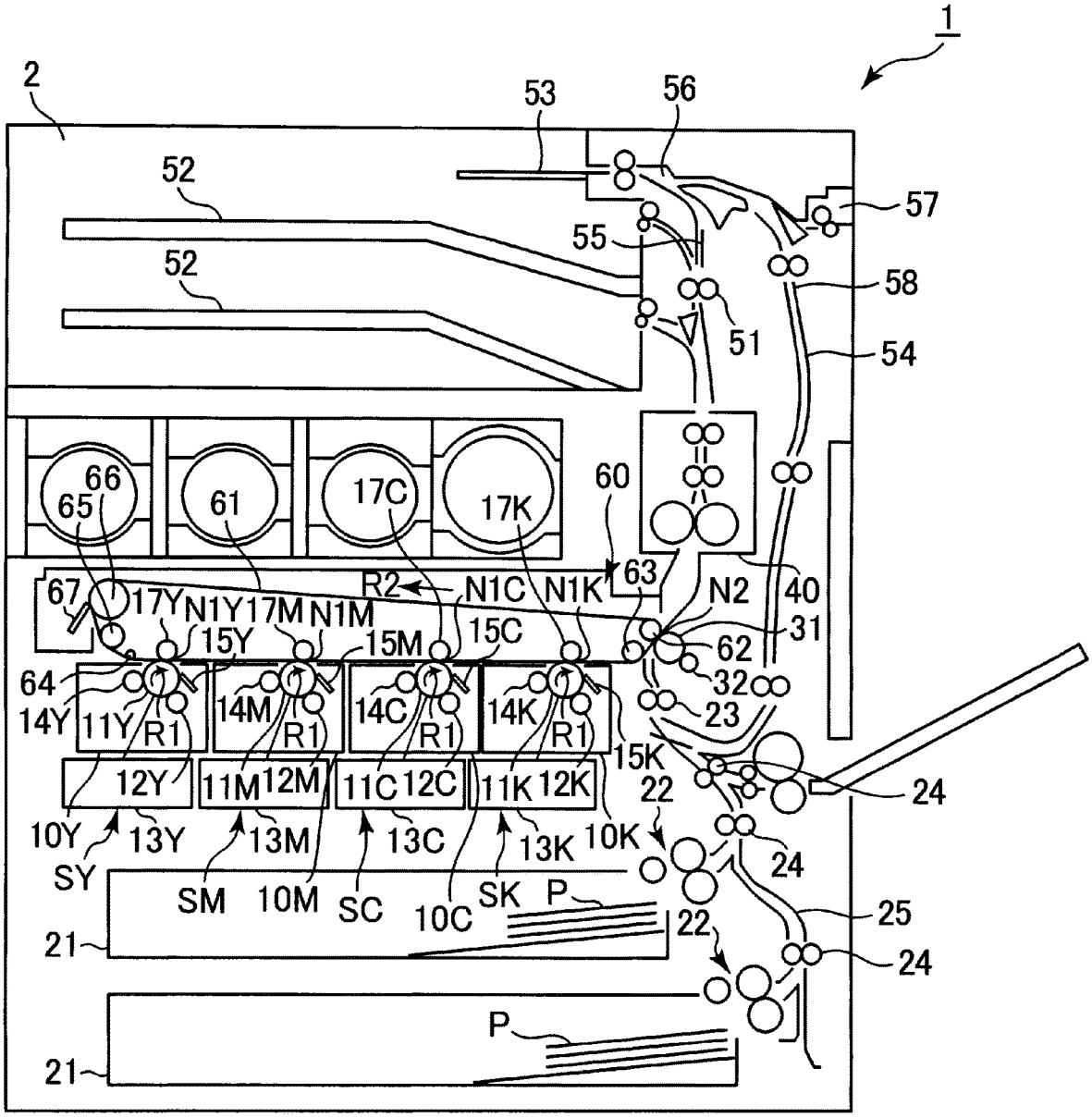
FIG. 1 is a sectional view of the image forming apparatus in the first embodiment of the present invention.

Hereinafter, the present invention is described in detail with reference to the drawing of an image forming apparatus which is in accordance with the present invention.

Embodiment 1

1. Overall Structure and Operation of Image Forming Apparatus

FIG. 1 is a sectional view of image forming apparatus 1 in this embodiment. Image forming apparatus 1 in this embodiment is capable of forming a full-color image with the use of an electrophotographic image forming method. It is of the so-called tandem type, and also, of the so-called intermediary transfer type. It is a multifunction image forming apparatus which is capable of functioning as a copying machine, a printer, and a facsimile machine.

Image forming apparatus 1 has multiple (four) image forming stations, more specifically, the first, second, third and fourth stations SY, SM, SC and SK, which form yellow (Y), magenta (M), cyan (C) and black (K) toner images, respectively. In a case where elements, of which station SY, for example, is made up, are the same in function and/or structure as the counterparts of other stations, they may be referred to without suffixes Y, M, C or K, which are related to color. In this embodiment, station S has photosensitive drum 11, charge roller 12, exposing apparatus 13, developing apparatus 14, primary transfer roller 17, drum cleaning apparatus 15, etc., which will be described later.

Photosensitive drum 11 is a photosensitive member (electrophotographic photosensitive member). It is a cylindrical image bearing member, which is for bearing a toner image. It is rotationally driven in the direction (indicated by an arrow mark R1 (clockwise direction)) at a preset peripheral velocity (process speed). As photosensitive drum 11 is rotationally driven, its surface (peripheral surface) is uniformly charged to a preset polarity (negative in this embodiment) and potential level by charge roller 12. The charged peripheral surface of photosensitive drum 11 is scanned by (exposed to) a beam of laser light emitted by exposing apparatus 13 (laser scanner) as an exposing means, while being modulated with the information of the image to be formed. Consequently, an electrostatic latent image (electrostatic image) is formed on the photosensitive drum 11. This electrostatic latent image on the photosensitive drum 11 is supplied with toner as developer, by developing apparatus 14. As a result, the latent image is developed into a visible image. That is, a toner image is formed on photosensitive drum 11. More specifically, as the peripheral surface of photosensitive drum 11 is exposed after being uniformly charged, exposed points of the peripheral surface of the photosensitive drum 11 reduce in potential level (in absolute value). In this embodiment, charged toner, which is the same in polarity as the charged peripheral surface of the photosensitive drum 11, adheres to these exposed points of the peripheral surface of the photosensitive drum 11 (reversal development). Also in this embodiment, the normal polarity of the toner is negative. In each station, charge roller 12, exposing apparatus 13, and developing apparatus 14 make up an image forming section which forms a toner image on photosensitive drum 11.

Image forming apparatus 1 is provided with intermediary transfer belt 61 as an intermediary transferring member, which faces photosensitive drums 11Y, 11M, 11C and 11K of stations SY, SM, SC and SK, respectively. Intermediary transfer belt 61 is in the form of an endless belt. It is suspended and tensioned by multiple rollers which are rotatably held by a frame (unshown). In this embodiment, the multiple rollers are inside secondary transfer roller 62, pre-transfer secondary transfer roller 63, first auxiliary roller 64, second auxiliary roller 65, and tension roller 66. Intermediary transfer belt 61 is driven by the driving force inputted into inside secondary transfer roller 62 which functions as a driving roller as well, in the direction (counterclockwise direction) indicated by arrow mark R2 in the drawing, at a peripheral velocity (process speed) which is equivalent to the peripheral velocity of photosensitive drum 11. Further, image forming apparatus 1 is provided with primary transfer rollers 17 as primary transferring members which are the primary transferring means. Primary transfer rollers 17 are positioned on the inward side of a loop (belt loop) which intermediary transfer belt 61 forms, between first auxiliary roller 64 and pre-transfer secondary transfer roller 62, facing corresponding photosensitive drums 11, one for one. Primary transfer roller 17 is kept pressed toward photosensitive drum 11 with the placement of intermediary transfer belt 61 between itself and corresponding photosensitive drum 11, forming thereby primary transfer portion N1 (primary transfer nip, which is an interface between photosensitive drum 11 and intermediary transfer belt 61). The multiple belt suspending-tensioning rollers other than secondary transfer inside roller 62, and primary transfer rollers 17, are rotated by the rotation of the intermediary transfer belt 61.

After the formation of a toner image on photosensitive drum 11, the toner image is transferred (primary transfer) onto intermediary transfer belt 61 by a preset amount of pressure and electrostatic bias applied in primary transfer nip N1, while intermediary transfer belt 61 is circularly driven. During the primary transfer, the primary transfer voltage (primary transfer bias), which is such DC voltage that is opposite in polarity from the normal toner charge, is applied to primary transfer roller 17 from a primary transfer power source (unshown). For example, during an operation for forming a full-color image, yellow, magenta, cyan, and black toner images formed on the corresponding photosensitive drums 11 are sequentially transferred in layers onto intermediary transfer belt 61. By the way, the present invention is not limited in application to an image forming apparatus such as the one in this embodiment, which is provided with four stations S which are different in the color of the image they form. Further, it is not limited in the order in which the four stations S are positioned. The toner which is remaining on the photosensitive drum 11 after the primary transfer is removed from the photosensitive drum 11, and recovered, by drum cleaning apparatus 15 as a means for cleaning photosensitive member.

Image forming apparatus 1 is provided with secondary transfer outside roller 31 as the secondary transferring member, or the secondary transferring means, which is on the outward side of the loop which intermediary transfer belt 61 forms, being positioned to oppose secondary transfer inside roller 62. Secondary transfer outside roller 31 is rotated by the rotation of intermediary transfer belt 61. It is kept pressed toward secondary transfer inside roller 62 which is an opposing member, with the presence of intermediary transfer belt 61 between itself and secondary transfer inside roller 62, forming thereby secondary transfer portion N2 (secondary transfer nip N2), in which intermediary transfer belt 61 contacts secondary transfer outside roller 31. After the transfer of the toner image onto intermediary transfer belt 61, the toner image is transferred (secondary transfer) onto a sheet P of transfer medium by the preset amount of pressure and electrostatic bias applied in second transferring nip N2, while a sheet P of transfer medium is conveyed through the nip N2 while remaining sandwiched between intermediary transfer belt 61 and secondary transfer outside roller 31. How secondary transferring portion N2 is supplied with electric power will be described later. After the secondary transfer, the toner (secondary transfer residual toner) which is remaining on intermediary transfer belt 61 is removed from intermediary transfer belt 61, and recovered, by belt cleaning apparatus 67 as a means for cleaning the intermediary transferring member.

Transfer medium P (sheets of transfer medium) is stored in a transfer medium storage 21 (cassette) as a transfer medium storing section; they are stored in layers on the lift-up of transfer medium storage 21. Sheets P of transfer medium in transfer medium storage 21 are moved out one by one from the storage by feeding mechanism 22 which has a pickup roller, etc., as a feeding means. Then, each sheet P of transfer medium is conveyed through a sheet conveyance passage, to registration unit 23 which has registration rollers as sheet conveying means, or the like, by which it is corrected in attitude. Then, sheet P is sent to secondary transferring portion N2 by registration unit 23 with such timing that it arrives at secondary transferring portion N2 at the same time as the toner image on intermediary transfer belt 61. By the way, the sheet conveyance path through which sheet P of transfer medium is conveyed comprises conveying members 24 (such as roller pairs and suction belt); and guide 25 which guides sheet P of transfer medium while controlling the sheet P in movement.

After the transfer of a toner image onto sheet P of transfer medium, sheet P is conveyed to fixing apparatus 40 as a fixing means. Fixing apparatus 40 fixes (melts, and then, solidifies) the toner image (unfixed) on sheet P to sheet P by applying heat and pressure to sheet P and the toner image thereon. After the fixation of the unfixed toner image to sheet P, sheet P is controlled in destination by sheet directing mechanism 51 so that it is discharged straight into delivery tray 52, or diverted into reversal conveyance mechanism 53, and then, to two-sided image formation sheet conveyance mechanism 54, in a case where it is necessary to form an image on both surfaces of sheet P. By the way, image forming apparatus 1 in this embodiment is provided with first conveyance passage 55 for conveying sheet P to reversal conveyance mechanism 53 after sheet P is conveyed through fixing apparatus 40, and reversal conveyance passage 56, through which sheet P is conveyed to be turned over after being conveyed thereto from first conveyance passage 55. Further, it has third conveyance passage 57, into which sheet P is discharged after being turned over by reversal conveyance passage 56, and two-sided mode conveyance passage 58 for reconveying sheet P into first conveyance passage 55 after sheet P is turned over by reversal conveyance passage 56.

In this embodiment, each station S has photosensitive drum 11, charge roller 12, developing apparatus 14, and drum cleaning apparatus 15, which make up process cartridge 10 which is removably installable in main assembly 2 of image forming apparatus 1. Further, in this embodiment, intermediary transfer belt 61, suspending-tensioning rollers 62-66, primary transfer rollers 17, and belt cleaning apparatus 67 make up intermediary transfer belt unit 60 which is removably installable in main assembly 2 of image forming apparatus 1.

Image forming apparatus 1 of the so-called intermediary transfer type, which uses intermediary transfer belt 61, does not directly place transfer medium in contact with photosensitive drum 11, being therefore capable of easily forming an image on a sheet of various transfer media such as thin paper, ordinary paper, cardstock, etc.

Preferable materials for intermediary transfer belt 61 are resinous substance such as polyimide and polyamide, and their mixture, and materials made by mixing charge inhibitor such as carbon black into various rubbers by a proper amount, and the like. Further, intermediary transfer belt 61 is formed so that its surface resistivity falls in a range of $1\times10^{9}-5\times10^{13}\Omega/\square$. Further, intermediary transfer belt 61 is in the form of an endless belt formed of film, the thickness of which is in a range of 0.04-0.5 mm.

2. Structure of Secondary Transfer Section

Figure 2:
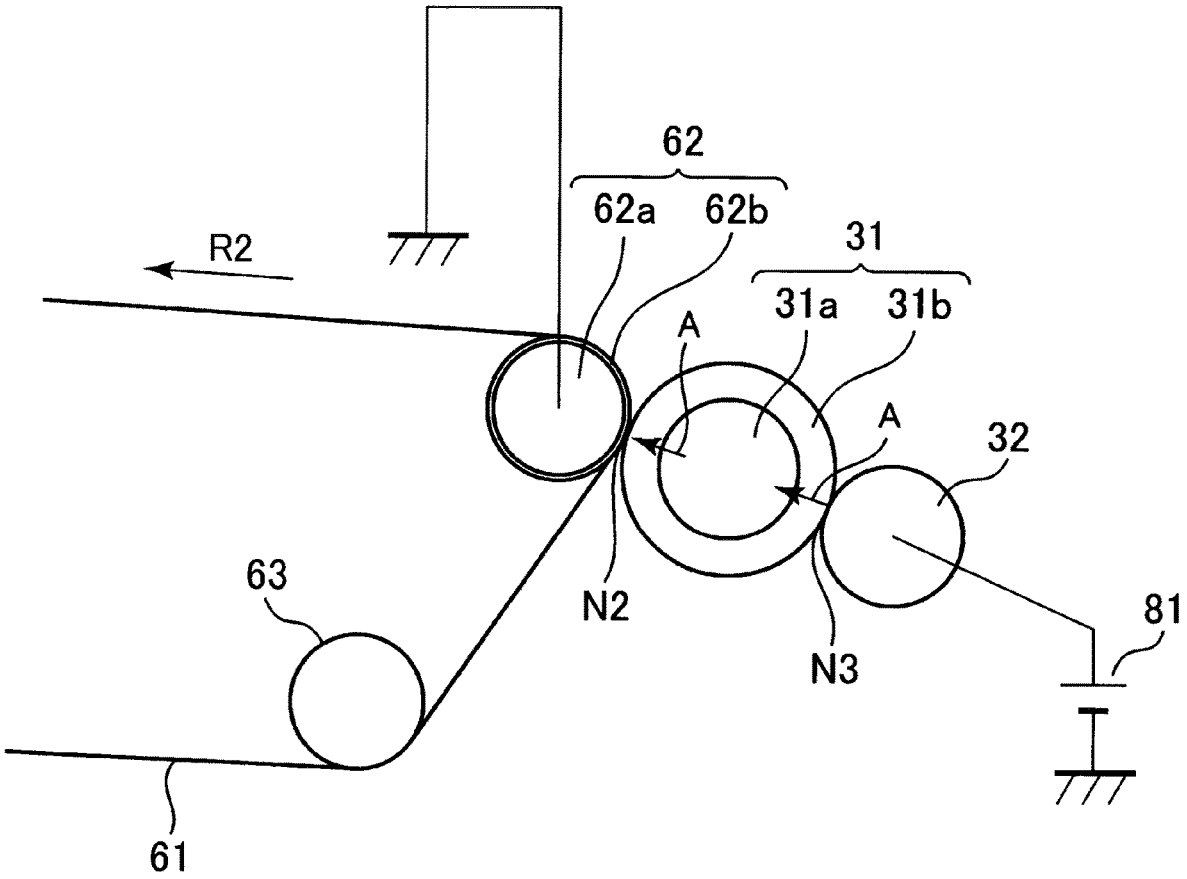
FIG. 2 is a schematic sectional view of the secondary transfer unit, and its adjacencies, of the image forming apparatus in FIG. 1.

FIG. 2 is a schematic sectional view (at plane which is roughly perpendicular to rotational axis of secondary transfer inside roller 62, rotational axis of secondary transfer outside roller 31, and rotational axis of power supply roller 32 which will be described later) of secondary transferring portion N2, and its adjacencies, in this embodiment.

Secondary transfer portion N2 is formed by placing secondary transfer outside roller 31 which is the secondary transferring member (transferring member, rotational transferring member, transfer roller), in contact with intermediary transfer belt 61 backed up by secondary transfer inside roller 62 as an opposing member (opposing roller). Secondary transfer inside roller 62 is positioned on the opposite side (inward side) of the intermediary transfer belt 61 from the toner image bearing surface of intermediary transfer belt 61. Secondary transfer outside roller 31 is positioned on the same side of intermediary transfer belt 61 as the toner image bearing surface of intermediary transfer belt 61.

In this embodiment, secondary transfer inside roller 62 is an elastic roller, which comprises metallic core 62*a*, and elastic layer 62*b* formed of electrically conductive rubber in a manner to cover the peripheral surface of metallic core 62*a*. In this embodiment, elastic layer 62*b* is formed of electrically conductive EPDM rubber. Also in this embodiment, secondary transfer inside roller 62 is 16 mm in external diameter, and 0.5 mm in the thickness of elastic layer 62*b*. The hardness of elastic layer 62*b* is 70° (Asker C scale), for example. Further, in this embodiment, secondary transfer inside roller 62 functions as a drive roller for driving intermediary transfer belt 61.

In this embodiment, secondary transfer outside roller 31 is also an elastic roller. It comprises metallic core 31*a* (core member), and elastic layer 31*b* formed of electrically conductive rubber sponge (foamed elastic substance) in a manner to cover the peripheral surface of the metallic core 31*a*. In this embodiment, metallic core 31*a* of secondary transfer outside roller 31 is solid. In this embodiment, elastic layer 31*b* of secondary transfer outside roller 31 is formed of electrically conductive NBR rubber which contains metallic complex as ion-conductive agent, and electron-conductive agent, or PDM rubber sponge. Further, in this embodiment, secondary transfer outside roller 31 is 20 mm in external diameter, and 6 mm in the thickness of elastic layer 31*b*. The hardness of elastic layer 31*b* is 28° (Asker C scale), for example. By the way, the material for the elastic layer may contain only ion-conductive agent. Further, secondary transfer outside roller 31 is kept pressed on the peripheral surface of intermediary transfer belt 61 backed up by secondary transfer inside roller 62, by a preset amount of pressure. It is rotated by the rotational movement of intermediary transfer belt 61.

Moreover, in this embodiment, power supply roller 32, which is a power supplying member (power supplying rotational member) for supplying secondary transfer outside roller 31 with voltage (electric current) is kept in contact with the peripheral surface of secondary transfer outside roller 31. Further, in this embodiment, the secondary transfer voltage (secondary transfer bias) is applied to secondary transfer outside roller 31 by way of power supply roller 32. The interface between intermediary transfer belt 61 and secondary transfer outside roller 31 is secondary transferring portion N2 (secondary transfer nip). Further, the interface between secondary transfer outside roller 31 and power supply roller 32 is power supplying section N3 (power supply nip). By the way, the position of secondary transfer portion N2 and the position of power supplying nip N3 are represented by the center of the secondary transfer outside roller 31 and the center of the power supply roller 32, in terms of their circumferential direction (rotational direction). Further, while the image forming apparatus 1 is in operation, the rotational axes of secondary transfer inside roller 62, secondary transfer outside roller 31, and power supply roller 32 are roughly parallel to each other.

In this embodiment, power supply roller 32 is a metallic roller formed of such a metallic substance as SUM or SUS, which are electrically conductive. In this embodiment, a metallic roller which plays the role of power supply roller 32 has portion 32*b* (FIG. 3) which can be placed in contact with secondary transfer outside roller 31, and axle portions 32*a* (FIG. 3) which are the lengthwise end portions of power supply roller 32 in terms of the direction parallel to the rotational axis of the power supply roller 32. Its entirety is formed of a metallic substance. In this embodiment, power supply roller 32 is a solid roller. Further, in this embodiment, the peripheral surface of portion 32*b* of power supply roller 32 is practically smooth. Further, in this embodiment, portion 32*b* of power supply roller 32 is 10 mm in external diameter. Further, power supply roller 32 is kept pressed on the peripheral surface of the elastic layer 31*b* of secondary transfer outside roller 31 by a preset amount of pressure. It is rotated by the rotation of the secondary transfer outside roller 31, as will be described later in detail.

The power supply roller 32 is in connection to secondary transfer power source 81 (high voltage power source circuit) as a voltage applying means (current supplying means). Secondary transfer power source 81 applies the secondary transfer voltage, which is DC voltage and opposite in polarity (positive in this embodiment) from the normal polarity of toner charge, to secondary transfer outside roller 31, through power supply roller 32. In this embodiment, secondary transfer power source 81 is a constant voltage power source. In this embodiment, the secondary transfer voltage is controlled to be stable in voltage. On the other hand, in this embodiment, secondary transfer inside roller 62 is grounded by way of metallic core 62*a*. Further, secondary transfer outside roller 31 is kept floating electrically. With the secondary transfer portion being supplied with the secondary transfer voltage in the manner described above, the toner image on intermediary transfer belt 61 is transferred onto a sheet P of transfer medium by the function of the transfer electric field formed in secondary transfer portion N2, while the sheet P moves through the secondary transfer portion N2. By the way, in this embodiment, the secondary transfer voltage is kept stable in voltage. However, the secondary transfer section may be structured so that the secondary transfer voltage is controlled so that the current flowed by the voltage remains stable.

Referring to the sectional view in FIG. 2, in this embodiment, power supply roller 32 is positioned so that in terms of the rotational direction of secondary transfer outside roller 31, the angle between secondary transfer portion N2 and power supplying nip N3 is roughly 180°. This angle is the angle between the straight line which connects the rotational axis of secondary transfer outside roller 31 and secondary transfer inside roller 62, and the straight line which connects the secondary transfer outside roller 31 and that of the peripheral surface (secondary transfer portion N2 or power supplying nip N3) of secondary transfer outside roller 31. That is, in this embodiment, power supply roller 32 is positioned so that secondary transfer portion N2 and power supplying nip N3 are positioned on the opposite side of the metallic core 31*a* of secondary transfer outside roller 31, from each other. This positional arrangement is for preventing electric current from directly flowing from power supply roller 32 to secondary transfer inside roller 62 by way of elastic layer 31*b* of secondary transfer outside roller 31. However, in a case where power is supplied as in this embodiment, power supply roller 32 has only to be positioned so that transfer current flows to secondary transfer portion N2 by way of metallic core 31*a* of secondary transfer outside roller 31. It is desired that the angle described above falls within a range of 180°±15°, for example.

Here, in a case where the secondary transfer section is structured to apply voltage to metallic core 31*a* of secondary transfer outside roller 31 unlike in this embodiment, the electric field generated around a given point in elastic layer 31*b* of secondary transfer outside roller 31 in terms of the circumferential direction of the secondary transfer outside roller 31 is always the same in direction. Therefore, polarization occurs to the ion-conductive agent in elastic layer 31*b* of secondary transfer outside roller 31. Therefore, as secondary transfer outside roller 31 increases in its cumulative usage, it gradually increases in electrical resistance. In comparison, in a case where the secondary transfer section is supplied with electric power as in this embodiment, the electrical charge supplied from power supply roller 32 reaches secondary transfer portion N2 by way of metallic core 31*a* of secondary transfer outside roller 31. Therefore, the electric field generated around a given point in elastic layer 31*b* of secondary transfer outside roller 31 in terms of the circumferential direction of secondary transfer outside roller 31 reverses in direction for roughly every half a turn of secondary transfer outside roller 31 (direction indicated by arrow mark A in FIG. 2), making it possible to prevent the occurrence of polarization to the ion-conductive agent in elastic layer 31*b* of secondary transfer outside roller 31, and therefore, to prevent the secondary transfer outside roller 31 from increasing in its electrical resistance.

3. Rotation of Intermediary Transfer Belt, Secondary Transfer Outside Roller, and Power Supply Roller In this embodiment, intermediary transfer belt 61 is driven by the driving force inputted into secondary transfer inside roller 62, which has a function of a drive roller, from a belt motor (unshown) as a driving force power source which is a driving means. The revolution setting portion of CPU as a controlling means with which image forming apparatus 1 is provided sets secondary transfer inside roller 62 in revolution (revolution of belt motor) to a value which corresponds to the image formation setting of image forming apparatus 1. In this embodiment, image forming apparatus 1 is enabled to change in process speed according to transfer medium type. Therefore, its CPU sets image forming apparatus 1 in the revolution of secondary transfer inside roller 62 (belt motor) according to the transfer medium type in the printing operation settings, with reference to the table stored in the memory, as a storing means, with which image forming apparatus 1 is provided. The belt motor rotates secondary transfer inside roller 62 at the revolution set by the CPU, to rotationally move intermediary transfer belt 61 at a preset transfer medium conveyance speed.

Secondary transfer outside roller 31 is kept pressed on intermediary transfer belt 61 backed up by secondary transfer inside roller 62, by a preset amount of pressure. Thus, it is rotated by the rotation of intermediary transfer belt 61. Therefore, as long as secondary transfer outside roller 31 is reliably rotated by the rotation of intermediary transfer belt 61, it is unlikely for secondary transfer outside roller 31 and intermediary transfer belt 61 to become different in peripheral velocity. However, in a case where secondary transfer outside roller 31 is substantial in torque, it sometimes occurs that the difference in peripheral velocity between secondary transfer outside roller 31 and intermediary transfer belt 61 becomes substantial. In such a case, it sometimes occurs that as a sheet P of transfer medium enters secondary transfer portion N2, sheet P reduces in conveyance speed, causing thereby a toner image to shrink in terms of transfer medium conveyance direction. As described above, secondary transfer outside roller 31 which is rotated by the rotation of intermediary transfer belt 61 has to reliably rotate relative to the rotation of intermediary transfer belt 61. From this viewpoint, secondary transfer outside roller 31 is preferred to be smaller in torque.

On the other hand, power supply roller 32, which is rotated by the rotation of the secondary transfer outside roller 31, also needs to be stable in rotation relative to the rotation of secondary transfer outside roller 31. If power supply roller 32 is not stable in rotation relative to the rotation of secondary transfer outside roller 31, it sometimes occurs that adherents such as the toner which is remaining adhered to secondary transfer outside roller 31 accumulate on the upstream side of the interface between secondary transfer outside roller 31 and power supply roller 32 in terms of sheet conveyance direction. These adherents sometimes move through the interface between secondary transfer outside roller 31 and power supply roller 32 all at once, and adhere to (soil) the back surface of a sheet P of transfer medium. Further, from the standpoint of ensuring that there remains electrical connection between power supply roller 32 and secondary transfer outside roller 31, power supply roller 32 needs to be stable in rotation. From the standpoint of ensuring that power supply roller 32 remains stable in rotation relative to the rotation of secondary transfer outside roller 31, it is necessary to keep power supply roller 32 pressed upon secondary transfer outside roller 31 with application of a preset amount of pressure. By the way, using a knurled metallic roller as the metallic shaft of power supply roller 32, and using an elastic roller, which comprises a metallic core and an electrically conductive layer wrapped around the metallic shaft, as power supply roller 32, result in increasing a secondary transfer section in cost.

However, in the case of a conventionally structured secondary transfer section, it sometimes becomes difficult to keep secondary transfer outside roller 31 and/or power supply roller 32 stable in rotation, as will be described later in detail.

4. Support Structure

Figure 3:
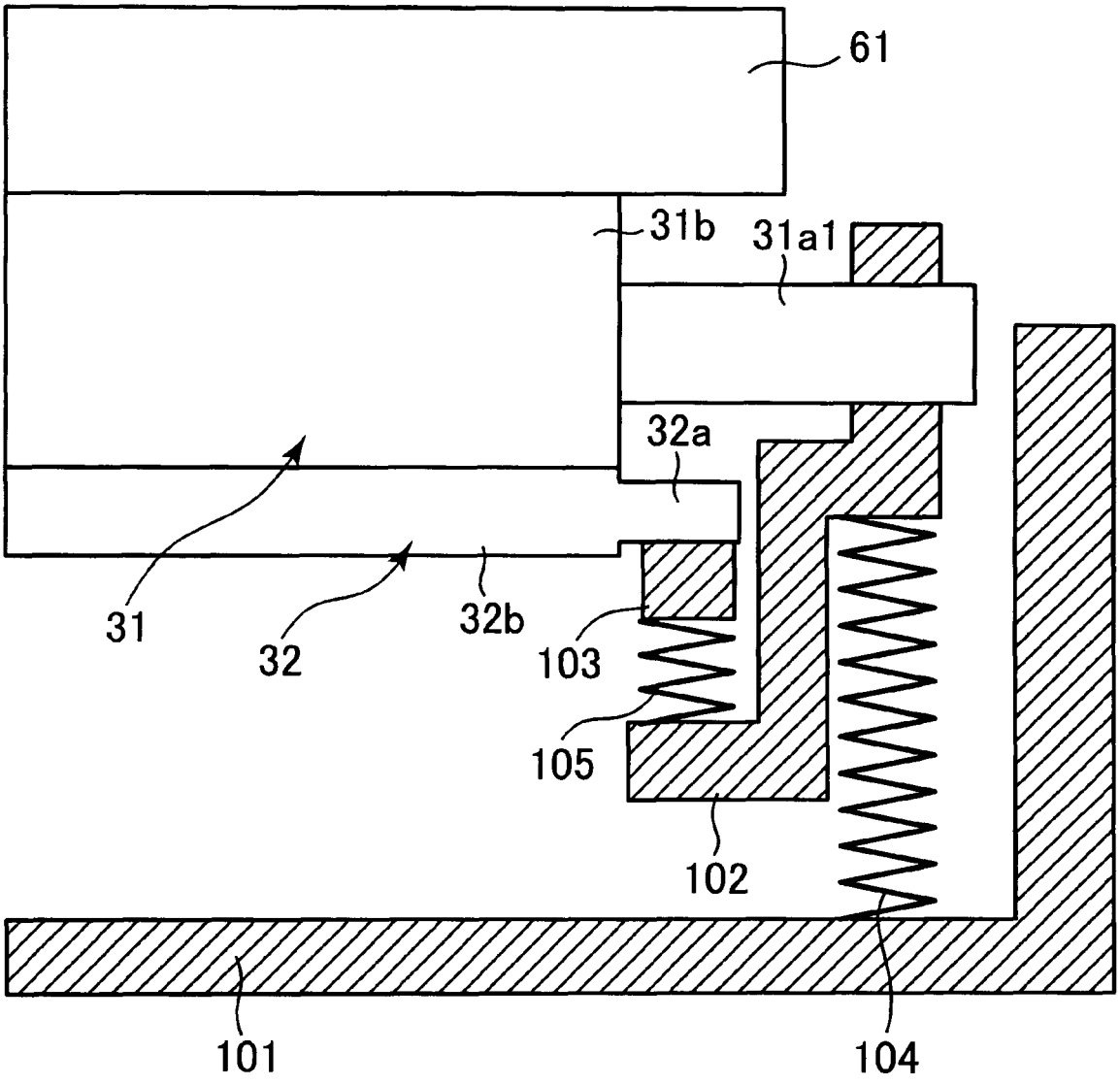
FIG. 3 is a schematic sectional view of the secondary transfer unit, showing how the outside secondary transfer roller and power supply roller are supported.

Next, the secondary transfer section in this embodiment is described with respect to its structure for supporting its secondary transfer outside roller 31 and power supply roller 32. Here, regarding the orientation of image forming apparatus 1 and its elements, the side of image forming apparatus 1, which is on the same side as the front side of a sheet of paper on which FIG. 1 is formed, will be referred to as "front side", and that which is on the same side as the rear side of the sheet of paper on which FIG. 1 is formed, will be referred to as "rear side". Further, it is assumed that a straight line which connects the "front side" and "rear side" is roughly parallel to the rotational axis of each of secondary transfer outside roller 31 and power supply roller 32 while image forming apparatus 1 is in operation. Further, this direction may be referred to as "thrust direction". FIG. 3 is a schematic sectional view (at plane which is roughly parallel to the thrust direction, which is parallel to the rotational axis of secondary transfer outside roller 31 and that of power supply roller 32) of the portion of the secondary transfer section, which supports secondary transfer outside roller 31 and power supply roller 32, in this embodiment. FIG. 3 shows only one of the lengthwise end portions of the secondary transfer section in terms of the thrust direction. However, in this embodiment, the lengthwise end portions of the secondary transfer section in terms of the thrust direction, which support secondary transfer outside roller 31 and power supply roller 32, are the same in structure (two end portions are practically symmetrical to each other in structure with respect to a plane which is roughly perpendicular to thrust direction).

Image forming apparatus 1 has holder 101 as a member for holding secondary transfer outside roller 31, power supply roller 32, etc. It has also second transfer bearing 102 as the first bearing for rotatably holding secondary transfer outside roller 31, and power supply bearing 103 as the second bearing for rotatably supporting power supply roller 32. Moreover, it has second transfer compression spring 104 as the pressure applying member (pressing member) for keeping second transfer bearing 102 pressed, and power supply compression spring 105 as the second pressing member (pressing member) for keeping pressuring portion 103 pressed.

Secondary transfer outside roller 31 is rotatably supported by second transfer bearing 102 at its lengthwise end portion in terms of the direction parallel to its rotational axis. To describe in greater detail, rotational axle portion 31*a*1 of secondary transfer outside roller 31, that is, the lengthwise end portion of secondary transfer outside roller 31 in terms of the direction parallel to its rotational axis, is rotatably supported by second transfer bearing 102. Second transfer bearing 102 is held by holder 101 in such a manner that it is allowed to move in the direction parallel to the direction in which pressure is applied to secondary transfer inside roller 62. Second transfer compression spring 104 is a compression spring. It is positioned so that one of its lengthwise ends remains in contact with second transfer bearing 102, and the other end remains in contact with the holder 101 to apply a preset amount of pressure to second transfer bearing 102 while image forming apparatus 1 is in operation. Thus, secondary transfer outside roller 31 remains pressed on intermediary transfer belt 61 backed up by secondary transfer inside roller 62, and is rotated by the rotation of intermediary transfer belt 61.

Further, power supply roller 32 is rotatably supported by power supply bearing 103 at its lengthwise end in terms of the direction parallel to its rotational axis. To describe in greater detail, rotational axle 32*a* of power supply roller 32, which is one of the lengthwise end portions of power supply roller 32, in terms of the direction parallel to its rotational axis, is rotatably supported by power supply bearing 103. Power supply bearing 103 is supported by second transfer bearing 102, being enabled to move relative to secondary transfer outside roller 31 in the direction in which pressure is applied. Power supply compression spring 105 is a compression spring. It is positioned so that it remains in contact with power supply bearing 103 by one of its lengthwise ends, whereas the other is in contact with second transfer bearing 102. It applies a preset amount of pressure to power supply bearing 103 while image forming apparatus 1 is in operation. Thus, power supply roller 32 remains pressed upon secondary transfer outside roller 31, and is rotated by the rotation of secondary transfer outside roller 31.

As described above, in this embodiment, second transfer bearing 102, which is allowed to move in the aforementioned direction, supports power supply bearing 103 and power supply compression spring 105. Therefore, it is possible to keep the secondary transfer section stable in the amount of pressure applied to secondary transfer outside roller 31 by power supply roller 32. Therefore, it is possible to keep the secondary transfer section stable in the rotation of secondary transfer outside roller 31 and power supply roller 32.

5. Effects

Next, the effects of how secondary transfer outside roller 31 and power supply roller 32 are supported in this embodiment are described along with how the two rollers 31 and 32 are supported by a comparative secondary transfer section. By the way, the elements of the comparative secondary transfer section, which correspond in function and/or structure to the counterparts in this embodiment, will be given the same referential codes.

Figure 4:
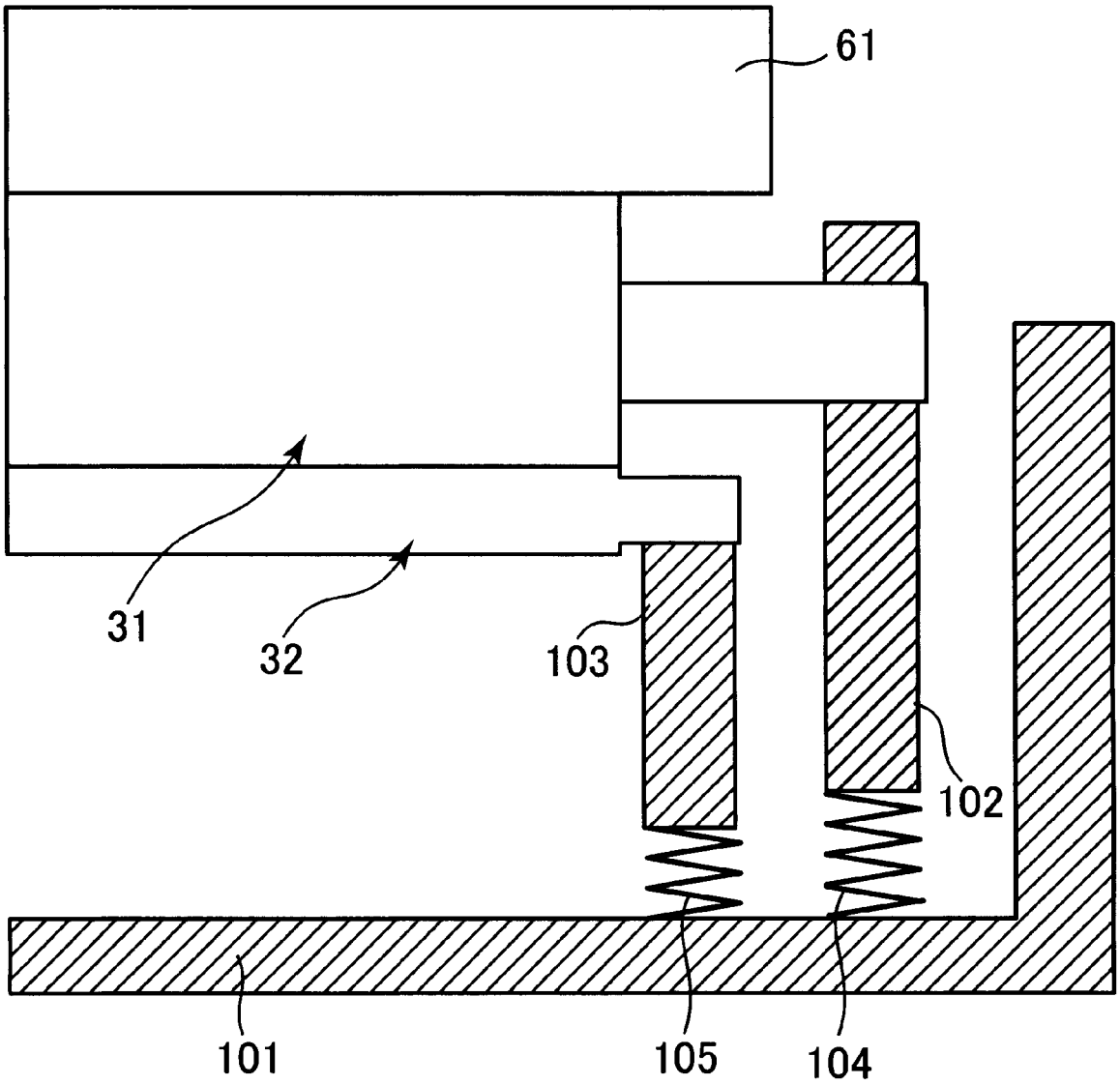
FIG. 4 is a schematic sectional view of the first of comparative examples of secondary transfer unit.

FIG. 4 is a schematic sectional view of one of the lengthwise ends of the first of the comparative examples of secondary transfer section, which is similar in structure to the one shown in FIG. 3. It shows how secondary transfer outside roller 31 and power supply roller 32 are supported in the first comparative example. In the first comparative example, both second transfer bearing 102 and power supply bearing 103 are supported by holder 101 in such a manner that both are enabled to move in the direction parallel to the direction in which they are pressed. Also, in the case of the first comparative secondary transfer section, it is structured so that second transfer compression spring 104 is positioned so that one of its lengthwise ends is in contact with second transfer bearing 102, whereas the other end is in contact with holder 101. Moreover, the comparative secondary transfer section is structured so that one end of power supply compression spring 105 is in contact with power supply bearing 103, whereas the other end is in contact with holder 101. That is, in the case of the structural arrangement of the first comparative secondary transfer section, a preset amount of pressure is applied (pressure regulated) to intermediary transfer belt 61 and secondary transfer outside roller 31 by secondary transfer outside roller 31 and power supply roller 32 by second transfer compression spring 104 and power supply compression spring 105, which are kept pressed on holder 101, respectively.

In the case of the comparative secondary transfer section, if the pressure generated by second transfer compression spring 104 is excessively strong because of the errors which occurred during the manufacturing of second transfer compression spring 104, for example, the following sometimes occurs. That is, secondary transfer outside roller 31 is pressed into where intermediary transfer belt 61 is. In other words, the pressure acts in the direction to move secondary transfer outside roller 31 away from power supply roller 32, reducing the secondary transfer section in the amount of pressure applied to secondary transfer outside roller 31 by power supply roller 32, which in turn makes power supply roller 32 unstable in rotation. If power supply roller 32 becomes unstable in rotation, it sometimes occurs that adherents such as toner on the peripheral surface of secondary transfer outside roller 31 collect on the upstream side of the interface between the secondary transfer outside roller 31 and power supply roller 32. If all the adherents such as toner collected on the upstream side of the interface between secondary transfer outside roller 31 and power supply roller 32 slip through the interface all at once as described previously, they adhere to (soil) the back surface of the sheet P. On the other hand, if second transfer compression spring 104 is excessively small in resiliency, the following sometimes occurs. That is, second transfer compression spring 104 allows secondary transfer outside roller 31 to invade into the space which power supply roller 32 occupies, increasing the secondary transfer section in the amount of pressure applied to the secondary transfer outside roller 31 by power supply roller 32, and increasing the secondary transfer section in the amount of braking force applied to secondary transfer outside roller 31 by power supply roller 32. As secondary transfer outside roller 31 is braked, sheet P between intermediary transfer belt 61 and secondary transfer outside roller 31 is braked, being thereby reduced in speed relative to the image on intermediary transfer belt 61, as described above. Consequently, it occurs sometimes that the toner on intermediary transfer belt 61 reduces in dimension in terms of transfer medium conveyance direction, as it is transferred from intermediary transfer belt 61 onto sheet P.

Figure 5:
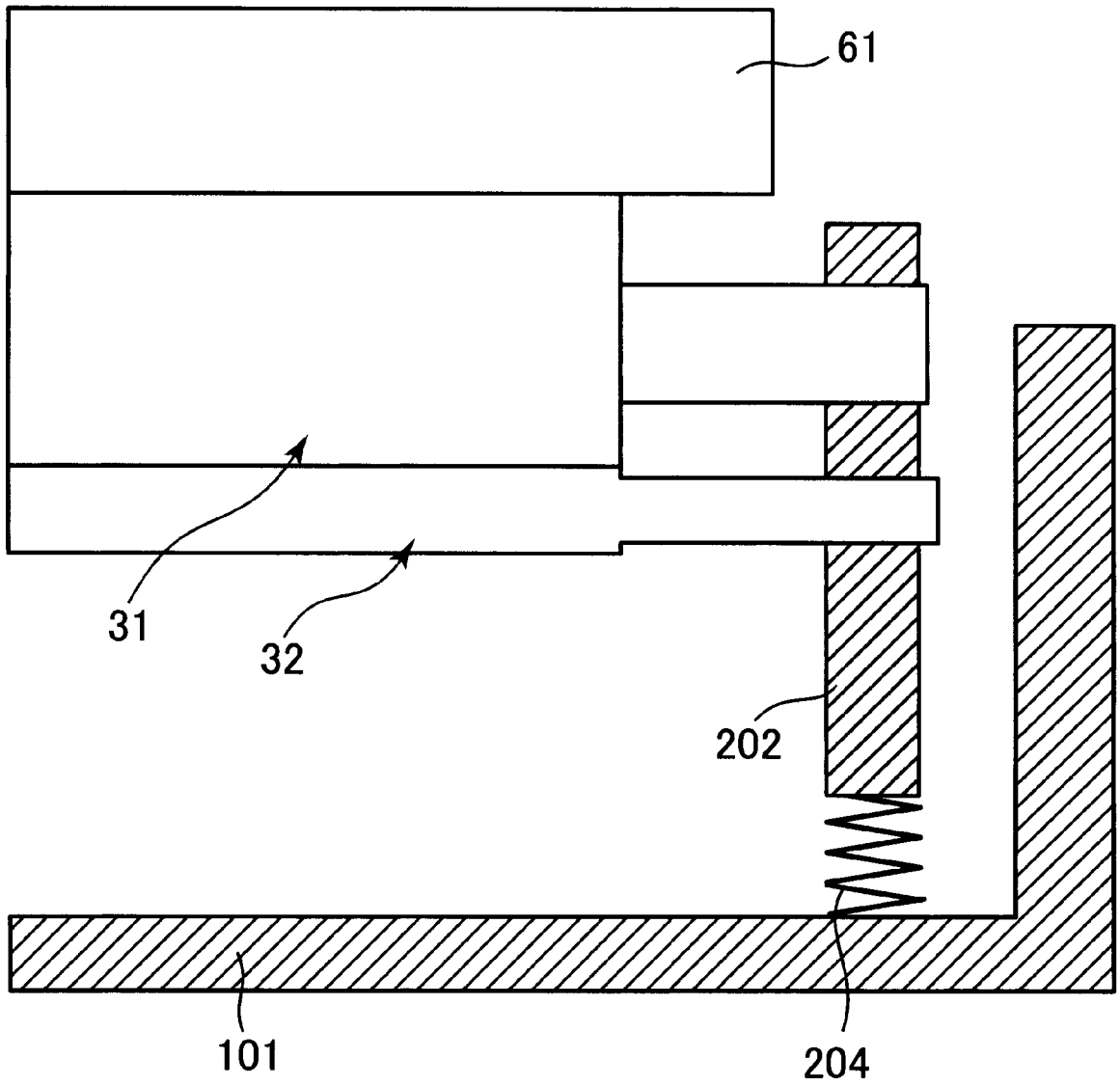
FIG. 5 is a schematic sectional view of the second of comparative examples of the secondary transfer unit.

FIG. 5 is similar to FIG. 3. It is a schematic sectional view of the second comparative example of secondary transfer section by which secondary transfer outside roller 31 and power supply roller 32 are supported. It shows the structure of one of the lengthwise end portions of the secondary transfer section, which supports secondary transfer outside roller 31 and power supply roller 32. It shows the structure of the supporting portion. In the case of the second comparative secondary transfer section, both secondary transfer outside roller 31 and power supply roller 32 are rotatably supported by bearing 202, which is movably supported by holder 101. Also, in the case of the second comparative example of the secondary transfer section, compression spring 204 is positioned so that one of its ends remains in contact with bearing 202, whereas the other end remains in contact with holder 101. That is, in the case of the second comparative example of secondary transfer section, not only is secondary transfer outside roller 31 kept pressed on intermediary transfer belt 61 by a preset amount (pressure regulation) of pressure generated by compression spring 204, but also, power supply roller 32 is positioned (positional regulation) so that secondary transfer outside roller 31 intrudes by a preset distance into the space which is being occupied by secondary transfer outside roller 31.

It is assumed here that in the case of the second comparative example of secondary transfer unit from the standpoint of ensuring that the secondary transfer outside roller 31 is satisfactorily rotated by the rotation of secondary transfer outside roller 31, it is necessary to position power supply roller 32 so that it appears as if power supply roller 32 invades by 0.2 mm into the space occupied by secondary transfer outside roller 31. It sometimes occurs that secondary transfer outside roller 31 and power supply roller 32 are imperfectly circular in cross-section, because of the errors which occur during the manufacturing of the rollers 31 and 32. In such a case, it is necessary to ensure that even if a point of the peripheral surface of secondary transfer outside roller 31, which is in the interface between the two rollers 31 and 32, and/or a point of the peripheral surface of the power supply roller 32, which is in the interface between the two rollers 31 and 32, moves in the direction to reduce the secondary transfer unit in the distance between the two rotational axes, the amount by which the power supply roller 32 invades into the space occupied by the power supply roller 32 remains at 0.2 mm. Therefore, it becomes necessary to reduce the secondary transfer unit in the distance between the rotational axis of secondary transfer outside roller 31 and that of power supply roller 32. However, setting the distance between the rotational axes of the two rollers 31 and 32 as described above is problematic in that as a point of the peripheral surface of secondary transfer outside roller 31, the distance of which from the rotational axis of the secondary transfer outside roller 31 is more than the intended value, or a point of the peripheral surface of the power supply roller 32, the distance of which from the rotational axis of the roller 32 is more than the intended value, moves into the interface between the two rollers 31 and 32, the secondary transfer unit becomes excessive in the amount by which power supply roller 32 invades into the space occupied by the secondary transfer outside roller 31. It is assumed here that secondary transfer outside roller 31 was manufactured 0.3 mm smaller in external diameter than a target value, and power supply roller 32 was manufactured 0.1 mm smaller in external diameter than a target value. In such a case, the following measure is sometimes taken. That is, the secondary transfer unit is manufactured so that secondary transfer power supply roller 32 invades by 0.6 mm into the space occupied by secondary transfer outside roller 31. In such a case, however, it sometimes occurs that the amount by which power supply roller 32 invades into the space occupied by secondary transfer outside roller 31 becomes 1.0 mm, which in turn increases the secondary transfer unit in the amount of the force applied by secondary transfer outside roller 31 in a manner to brake the rotation of the secondary transfer outside roller 31. On the other hand, it is possible that the amount by which power supply roller 32 invades into the space occupied by secondary transfer outside roller 31 is set in consideration of a case in which power supply roller 32 was manufactured greater in external diameter than a target value. In such a case, if secondary transfer outside roller 31 is manufactured smaller in external diameter than a target value, and power supply roller 32 also is manufactured smaller in external diameter than a target value, the secondary transfer unit becomes smaller in the amount of pressure applied to secondary transfer outside roller 31 by power supply roller 32, which in turn makes power supply roller 32 unsatisfactory in rotation, causing the soiling of the back surface of sheet P of transfer medium as described above.

In comparison, in the case of the secondary transfer section in this embodiment, not only is second transfer bearing 102 kept under the pressure from second transfer compression spring 104, but also, power supply bearing 103 held by second transfer bearing 102 is kept under the pressure from power supply compression spring 105 held by second transfer bearing 102. That is, in this embodiment, secondary transfer outside roller 31 is kept pressed on intermediary transfer belt 61 by a preset amount of pressure generated by second transfer compression spring 104. Also in this embodiment, power supply roller 32 is kept pressed on secondary transfer outside roller 31 by a preset amount of pressure (pressure regulation) generated by power supply compression spring 105. Moreover, in this embodiment, in order to allow power supply roller 32 and power supply compression spring 105 to move together in the direction parallel to the direction in which secondary transfer outside roller 31 is pressed, power supply bearing 103 and power supply compression spring 105 are held by second transfer bearing 102. Therefore, even if second transfer compression spring 104 is unstable in the amount of pressure it generates, power supply roller 32 and power supply compression spring 105 move with secondary transfer outside roller 31 in the direction parallel to the direction of the pressure second transfer compression spring 104 generates. Therefore, they are not affected by the instability of second transfer compression spring 104 in the amount of pressure it generates, or the secondary transfer section is minimized in the effects of the instability. Further, power supply roller 32 is regulated in pressure. Therefore, even if secondary transfer outside roller 31 and power supply roller 32 (in particular, secondary transfer outside roller 31 which has elastic layer 31*b*) are not perfectly circular in cross-section as described above, power supply roller 32 changes in position in proportion to the amount of imperfection of power supply roller 32 in terms of cylindricality. Therefore, the secondary transfer section is not affected by the fluctuation in the amount of pressure generated by second transfer compression spring 104, or prevented from being affected by the problem that secondary transfer outside roller 31 and power supply roller 32 are not perfectly cylindrical, or the effects are satisfactorily neutralized.

As described above, in this embodiment, image forming apparatus 1 has: image bearing members 11 which bear a toner image; image forming sections 12, 13, and 14 which form a toner image on image bearing members 11; intermediary transfer belt 61 onto which toner images are transferred from image bearing members 11; transfer roller 31 which comprises metallic core 31*a*, and elastic layer 31*b* which is formed in a manner to wrap around metallic core 31*a*, and forms transferring portion N2 by being placed in contact with the outward surface of intermediary transfer belt 61; secondary transfer inside roller 62 which forms transferring portion N2 in coordination with transfer roller 31; electrical power source 81 which supplies transferring portion N2 with electric current; and metallic roller 32 which forms an electric current path through which the electrical current supplied from electric power source 81 flows. Further, this image forming apparatus 1 has: first bearing 102 positioned at lengthwise ends of transfer roller 31 in terms of the direction parallel to the rotational axis of transfer roller 31 to rotatably support transfer roller 31; holder 101 which movably supports bearing 102; first pressing member 104 positioned between first bearing 102 and holder 101 to keep transfer roller 31 pressed on intermediary transfer belt 61; second bearing 103 positioned at the lengthwise ends of metallic roller 32 in terms of the direction parallel to the rotational axis of the metallic roller 32 to be movably supported by bearing 102 to rotatably support metallic roller 32; and second pressing member 105 positioned between second bearing 103 and first bearing 102 to move second bearing 103 relative to first bearing 102 to keep metallic roller 32 pressed on transfer roller 31. In this embodiment, the peripheral surface of power supply roller 32, which is in contact with transfer roller 31, is smooth.

As described above, in this embodiment, power supply bearing 103 and power supply compression spring 105 are held by movable second transfer bearing 102. Therefore, it is possible to prevent the problem attributable to instability in the rotation of secondary transfer outside roller 31 and power supply roller 32 which are rotated by the rotation of the components with which they are in contact. Thus, this embodiment can make it possible for secondary transfer outside roller 31, and power supply roller 32 which is in contact with secondary transfer outside roller 31, to remain stable in rotation.

Embodiment 2

Next, another embodiment of the present invention is described. The image forming apparatus in this embodiment is practically the same in basic structure and operation as image forming apparatus 1 in the first embodiment. Therefore, the elements of the image forming apparatus in this embodiment, which are the same as, or correspond to, the counterparts of the image forming apparatus 1 in the first embodiment, are given the same referential codes as those given to the counterparts, and are not described in detail.

In this embodiment, the secondary transfer section is concretely described with respect to its basic structural arrangement for supporting secondary transfer outside roller 31 and power supply roller 32. By the way, regarding the orientation of the image forming apparatus and its elements, in this embodiment, the side of image forming apparatus 1, which is on the front side of FIG. 1 will be referred to as the "front side", and that on the rear side of FIG. 1, will be referred to as the "rear side", as they were in the first embodiment. Further, the direction (which is roughly parallel to direction parallel to each of rotational axes of secondary transfer outside roller 31 and power supply roller 32 while image forming apparatus 1 is in operation) which is parallel to a straight line which connects the front and rear sides of image forming apparatus 1 may be referred to as the "thrust direction". Further, the upward-downward direction of image forming apparatus 1 and its elements means the direction parallel to the gravity direction (vertical direction). It does not mean "directly upward direction", or "directly downward direction". It includes the top and bottom side of a horizontal plane which coincides with a given element or position.

1. Secondary Transfer Unit

Figure 6:
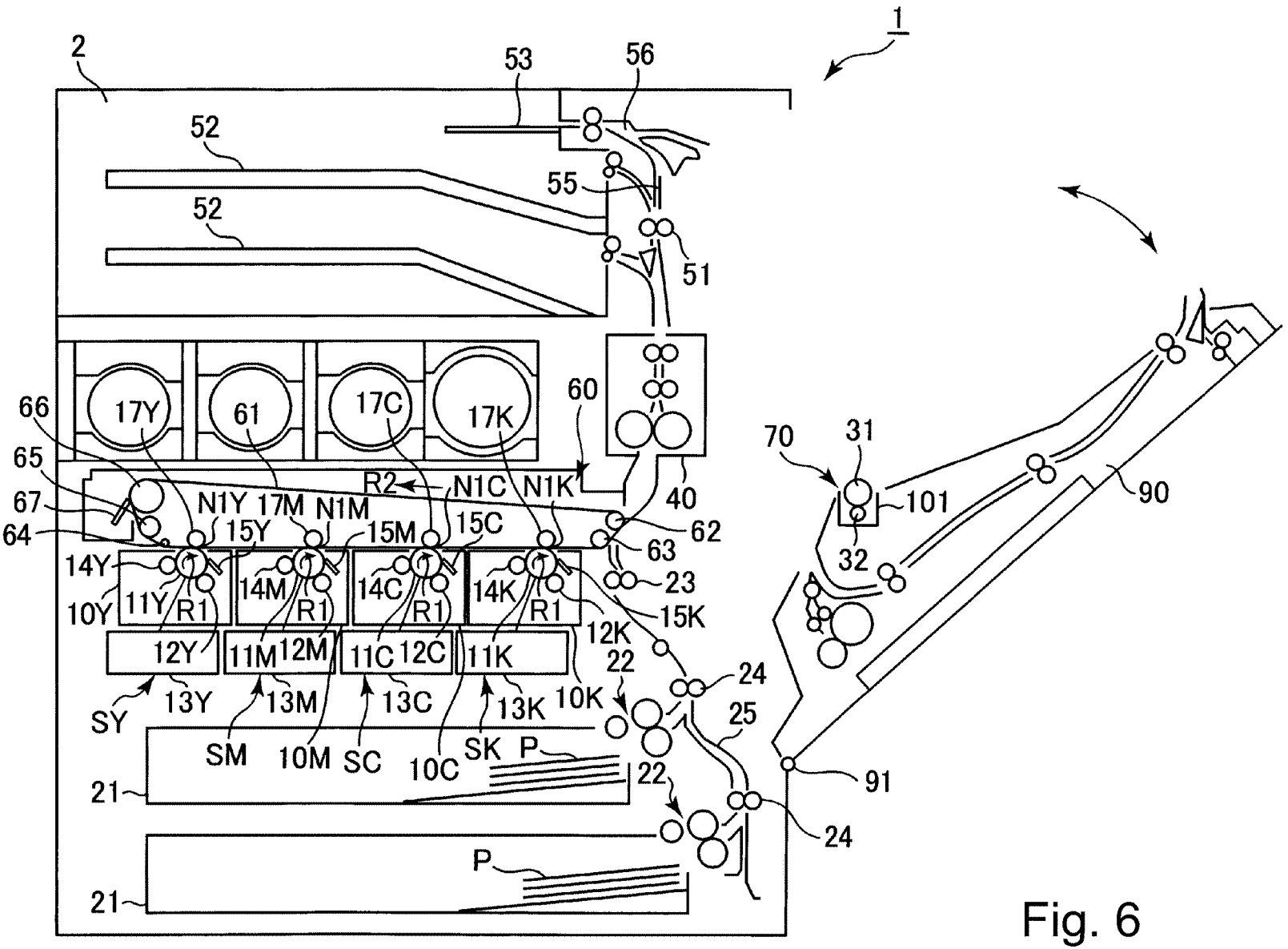
FIG. 6 is a sectional view of the image forming apparatus, when the right door unit of which is open.

FIG. 6 is a sectional view of image forming apparatus 1 in this embodiment when right door unit 90, which will be described later, is open.

Image forming apparatus 1 has right door unit 90 as a component which can be opened to expose the interior of apparatus main assembly 2. Right door unit 90 is attached to the right side of apparatus main assembly 2. Image forming apparatus 1 is structured so that right door unit 90, which is attached to the bottom portion of apparatus main assembly 2, is pivotally movable about rotational axis 91 which is roughly parallel to the thrust direction, to be pivoted downward to expose the interior of apparatus main assembly 2, or upward to cover the interior of apparatus main assembly 2. Right door unit 90 can be opened or closed by an operator such as a user, a service person, etc., with the use of a knob (unshown) or the like with which right door unit 90 is provided.

Right door unit 90 is opened in a manner to separate at least a part of the passage through which sheet P is conveyed from transfer medium storage 21 to fixing apparatus 40 by way of secondary transfer portion N2, into the front side (surface onto which toner image is transferred) of sheet P, and the back side. Secondary transfer unit 70 which has secondary transfer outside roller 31, power supply roller 32, holder 101, second transfer bearing 102, power supply bearing 103, etc., as described in the description of the first embodiment, is attached to right door unit 90, in the same manner as in the case of the first embodiment. Opening right door unit 90 makes secondary transfer outside roller 31 separate from intermediary transfer belt 61, and also, makes secondary transfer unit 70 move with right door unit 90, allowing an operator to access secondary transfer unit 70 attached to opened right door unit 90.

In this embodiment, secondary transfer outside roller 31 is shorter in life expectancy than apparatus main assembly 2. This is why image forming apparatus 1 is structured so that secondary transfer outside roller 31 is replaceably installable in apparatus main assembly 2. On the other hand, in this embodiment, power supply roller 32 is a metallic roller, making it unlikely for power supply roller 32 to be replaced. However, it is sometimes necessary to remove adherents such as toner on the peripheral surface of power supply roller 32 to clean power supply roller 32. In this embodiment, therefore, image forming apparatus 1 is structured so that an operator can remove second transfer bearing 102 from holder 101 by accessing secondary transfer unit 70 by opening right door unit 90 as described above to remove second transfer bearing 102 from holder 101 as will be described later in detail. That is, in this embodiment, image forming apparatus 1 is structured so that secondary transfer outside roller 31, power supply roller 32, etc., can be removed from holder 101 along with second transfer bearing 102. Further, an operator can remove secondary transfer outside roller 31 from second transfer bearing 102 to replace secondary transfer outside roller 31 with a brand-new one, and also, move power supply roller 32 from power supply bearing 103 to clean power supply roller 32.

By the way, the secondary transfer unit 70 may be structured so that secondary transfer outside roller 31 and power supply roller 32 can be removed from second transfer bearing 102 without removing second transfer bearing 102 from holder 101, as will be described later in detail. Further, image forming apparatus 1 may be structured so that secondary transfer unit 70 can be removably attachable to right door unit 90 along with holder 101. In such a case, the replacement of secondary transfer outside roller 31, and cleaning of power supply roller 32, may be done after the removal of secondary transfer unit 70 from right door unit 90.

2. Support Structure

Figure 7:
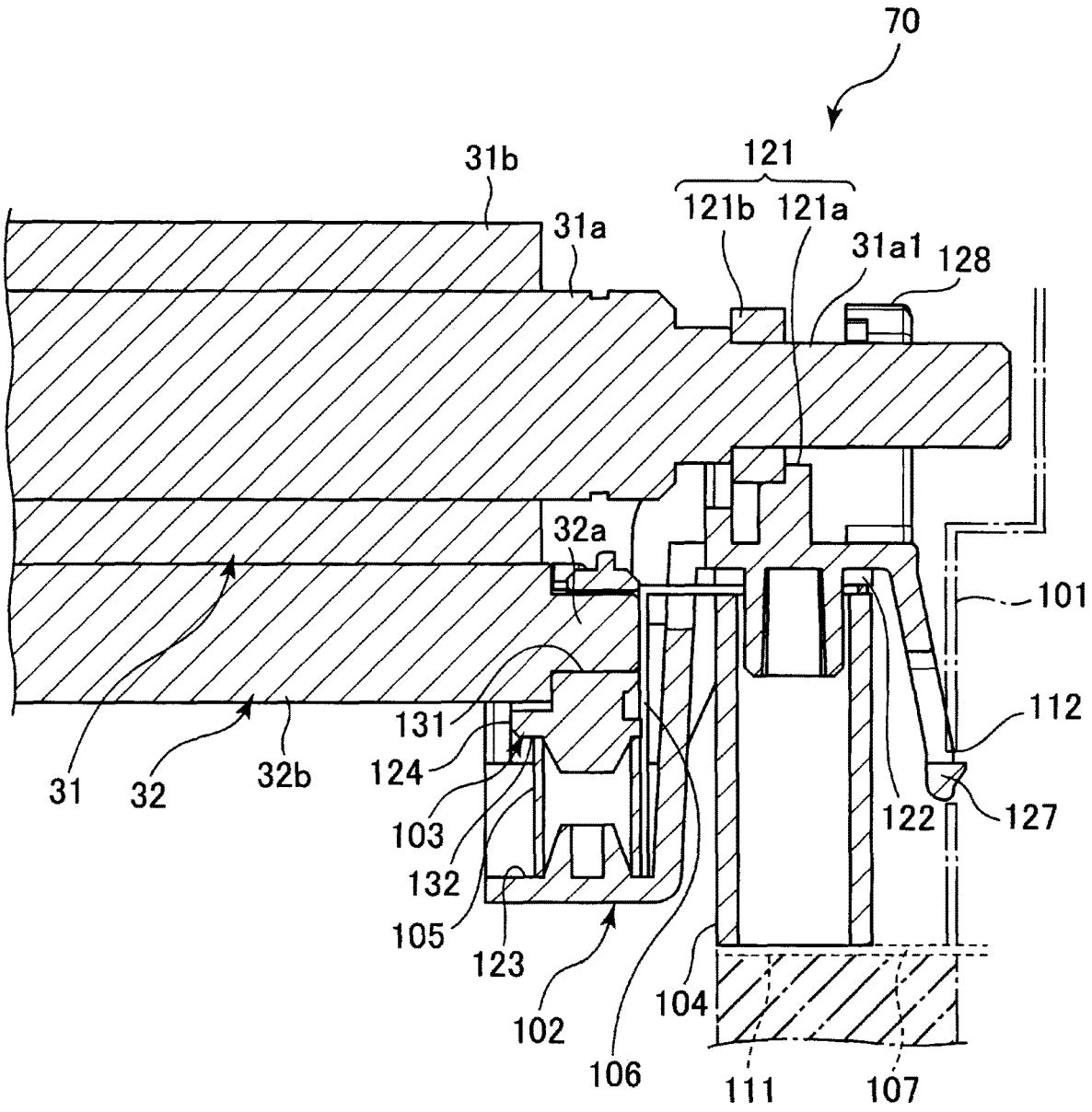
FIG. 7 is a sectional view of one of the lengthwise end portion of the secondary transfer unit, showing how the secondary transfer outside roller and power supply roller are supported.
Figure 8:
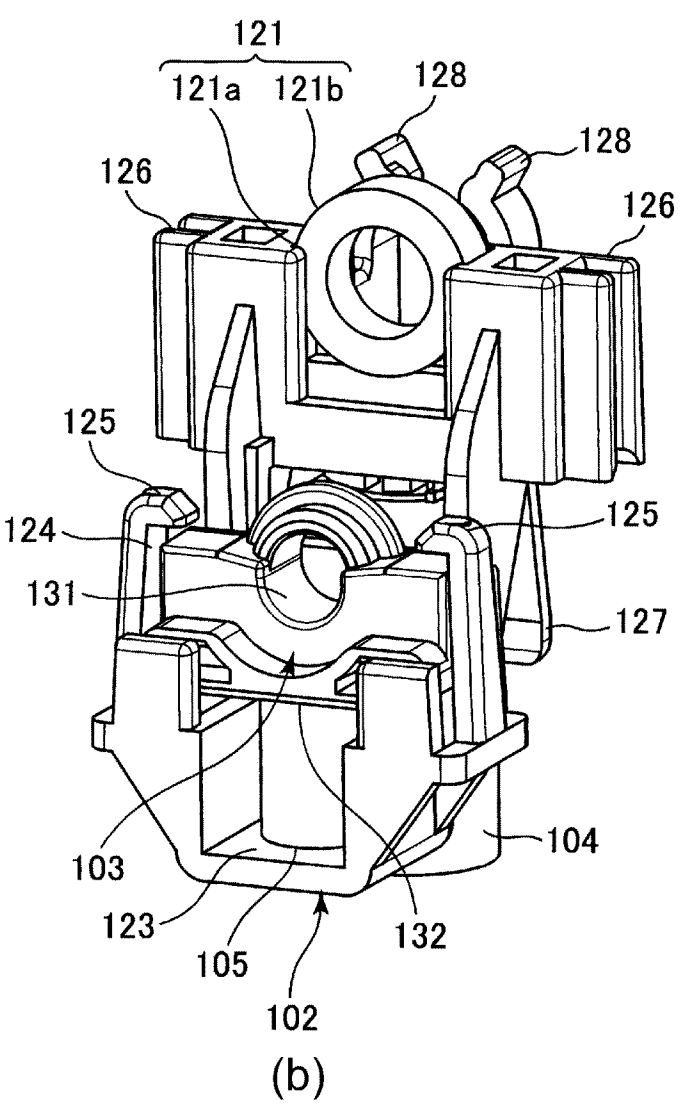
FIG. 8, parts (a) and (b), is a perspective view of the portion of the secondary transfer unit, by which the secondary transfer outside roller and power supply roller are supported, showing the structure of the portion.
Figure 8:
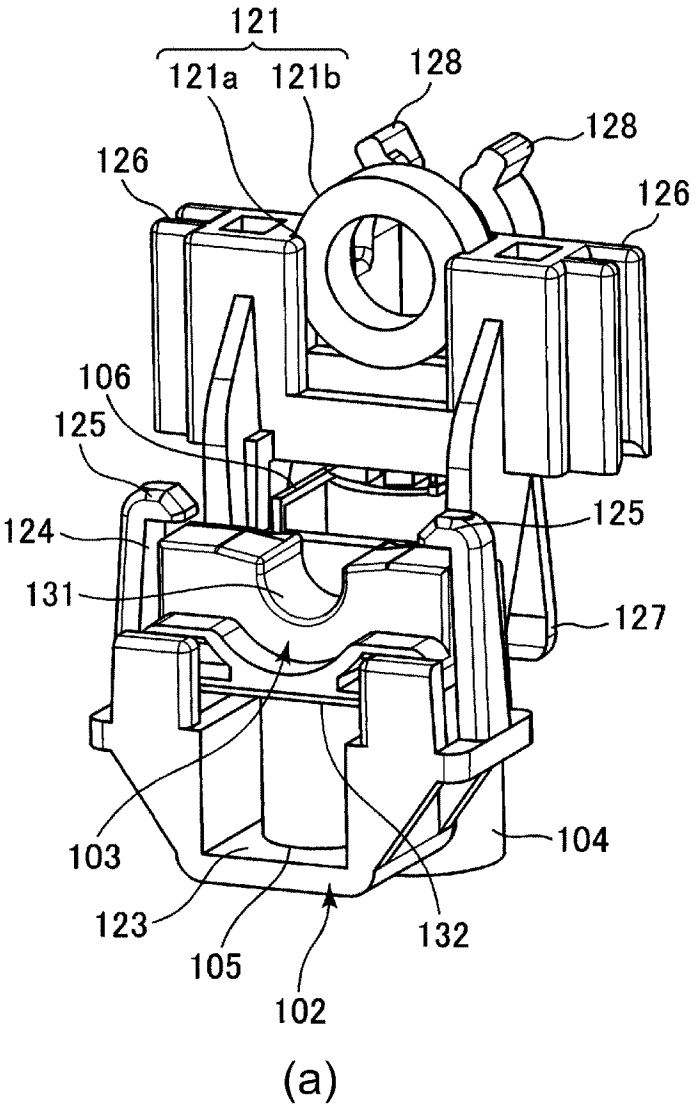
Figure 9:
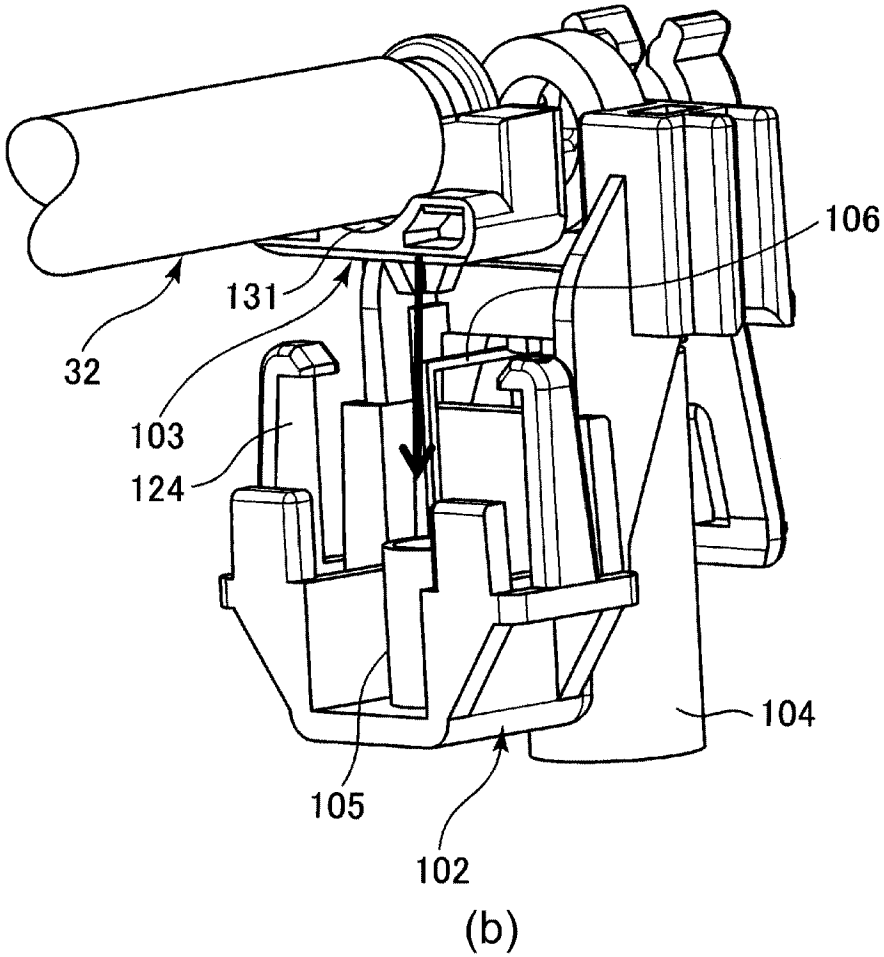
FIG. 9, parts (a) and (b), is a partially exploded view of one of the lengthwise end portions of the secondary transfer unit for describing the sequential steps through which the secondary transfer unit is assembled.
Figure 9:
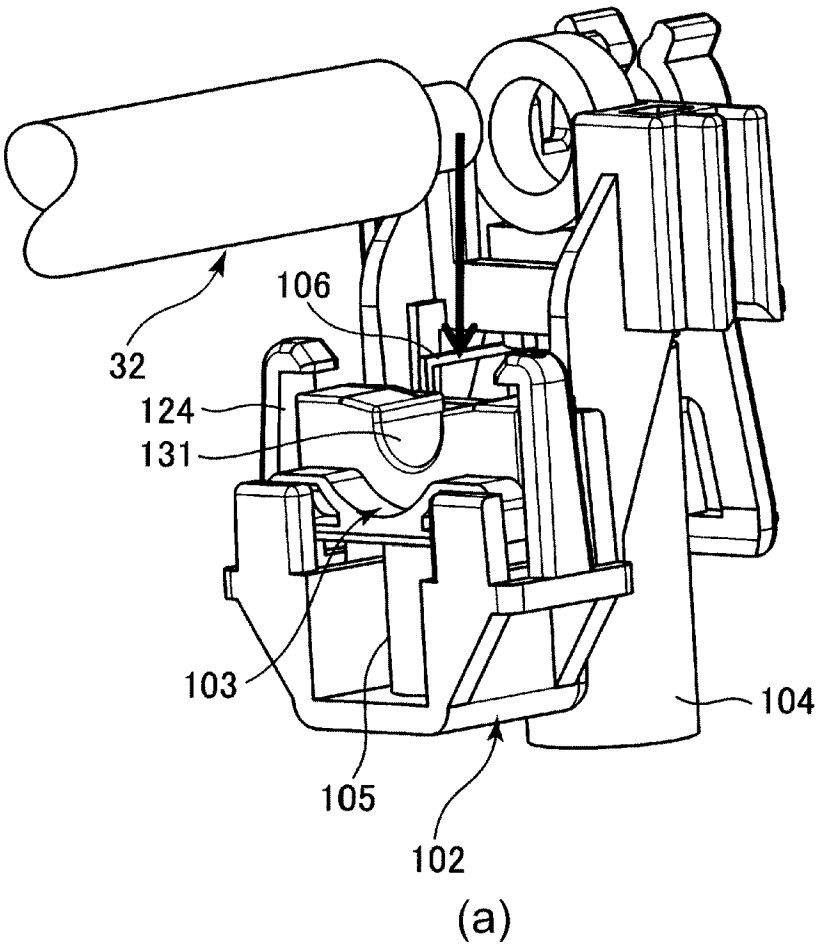
Figure 10:
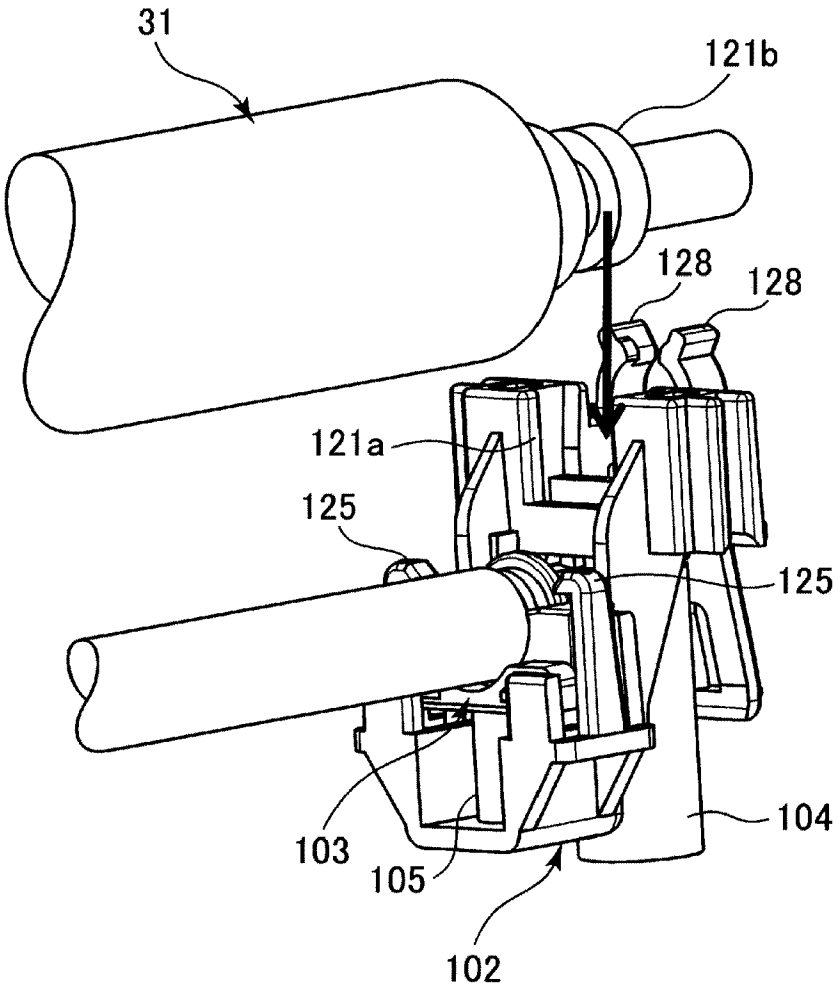
FIG. 10, parts (a) and (b), also is a partially exploded view of the secondary transfer unit for describing the sequential steps through which the secondary transfer unit is assembled.
Figure 10:
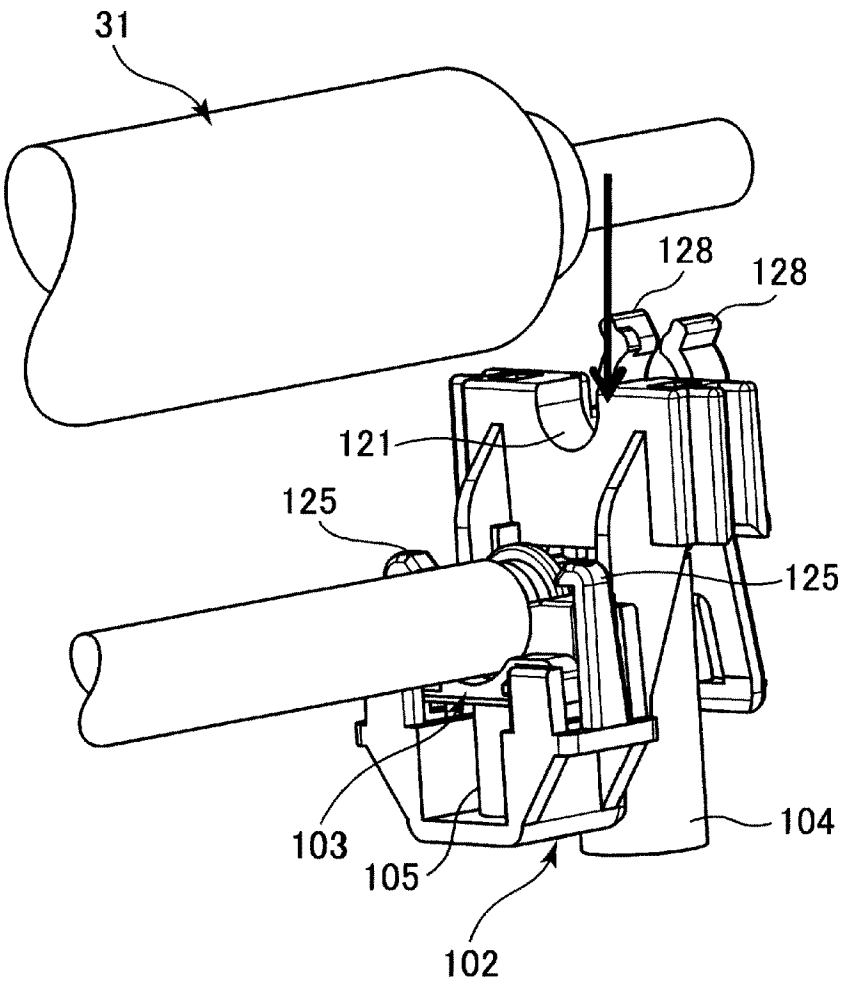

FIG. 7 is a sectional view of one of the lengthwise end portions of secondary transfer unit 70, and its adjacencies (at plane which is roughly parallel to the thrust direction which is parallel to the rotational axes of secondary transfer outside roller 31 and power supply roller 32) in this embodiment. It shows the structure of the secondary transfer unit 70, which supports the two rollers 31 and 32. FIG. 8 is a perspective view of a combination of second transfer bearing 102 and power supply bearing 103, and their adjacencies, in this embodiment, as seen from the center of the secondary transfer unit 70 in terms of the thrust direction. FIG. 9 is an exploded perspective view of second transfer bearing 102 and power supply roller 32, and their adjacencies. It is for showing how power supply roller 32 is attached to second transfer bearing 102 shown in FIG. 8. Further, FIG. 10 is a partially exploded perspective view of one of the lengthwise end portions of secondary transfer unit 70. It shows how secondary transfer outside roller 31 is attached to second transfer bearing 102. FIGS. 7 to 10 show only one of the lengthwise end portions of the secondary transfer unit 70. However, in this embodiment, the portion of the secondary transfer section, which supports secondary transfer outside roller 31 and power supply roller 32 at one of the lengthwise end portions of the secondary transfer unit 70 in terms of the thrust direction, and the counterpart at the other lengthwise end, are similar in structure, and symmetrical to each other with reference to a plane which is roughly perpendicular to the thrust direction, and coincides with the center of the secondary transfer unit 70 in terms of the thrust direction. Parts (a) and (b) of FIGS. 8 to 10 concretely show examples of the lengthwise end portion of secondary transfer unit 70, which are partially different from each other as will be described later. It is assumed here that in FIGS. 7 to 10, each component (member) is in the state in which it is when right door unit 90 is virtually entirely open. The upward direction in the drawings is the upward direction which is parallel to gravity direction. The downward direction in the drawings is the downward direction which is parallel to the gravity direction.

Referring to FIGS. 6 and 7, secondary transfer unit 70 has: holder 101, second transfer bearing 102, power supply bearing 103, second transfer compression spring 104, and power supply compression spring 105. Roughly speaking, holder 101 is in the form of such a box that has an opening which faces upward when right door unit 90 is open. It is structured so that second transfer bearing 102 is attachable to the lengthwise end portions of holder 101 in terms of the thrust direction. Therefore, secondary transfer outside roller 31, power supply roller 32, etc., are assembled into holder 101 by being supported by second transfer bearing 102, so that power supply roller 32 and secondary transfer outside roller 31 are positioned on the bottom and top sides, respectively, to each other. A part of the peripheral surface of secondary transfer outside roller 31 remains exposed outward from holder 101. Closing of right door unit 90 causes the peripheral surface of secondary transfer outside roller 31 to come into contact with the peripheral surface of intermediary transfer belt 61 backed up by secondary transfer inside roller 62. Further, when right door unit 90 is remaining closed, secondary transfer outside roller 31 is kept pressed on intermediary transfer belt 61 backed up by secondary transfer inside roller 62 by a preset amount of pressure generated by second transfer compression spring 104. Also, when right door unit 90 is remaining closed, power supply roller 32 is kept pressed on secondary transfer outside roller 31 by a preset amount of pressure generated by power supply compression spring 105.

Referring to FIGS. 7, 8(*a*) and 8(*b*), second transfer bearing 102 has secondary transfer outside roller supporting portion 121, which rotatably supports rotational axle portion 31*a*1 of secondary transfer outside roller 31 which is one of the lengthwise end portions of metallic core 31*a* of secondary transfer outside roller 31 in terms of the direction parallel to the rotational axis of secondary transfer outside roller 31. In this embodiment, secondary transfer outside roller supporting portion 121 has: bearing 121*b* (sliding bearing) for rotatably supporting axle portion 31*a*1 of secondary transfer outside roller 31; and bearing holding portion 121*a* for holding this bearing 121*b*. However, secondary transfer outside roller supporting portion 121 does not need to be provided with a bearing or the like. That is, it may be structured so that it directly supports axle portion 31*a*1 of secondary transfer outside roller 31. In such a case, secondary transfer outside roller supporting portion 121 may be provided with an upwardly facing bearing recess which is roughly U-shaped in cross-section (FIG. 10(*a*)). The downwardly facing surface of the bottom portion of secondary transfer outside roller supporting portion 121 of second transfer bearing 102 is provided with secondary transfer pressure bearing portion 122 which bears the pressure from second transfer compression spring 104. The bottom end of second transfer compression spring 104 remains in contact with secondary transfer pressure bearing surface 111, with which the upwardly facing surface of holder 101 is provided. Referring to FIGS. 8(*a*) and 8(*b*), second transfer bearing 102 is provided with guide accommodating portion 126 which engages with guide portion (unshown) of holder 101 in such a manner that holder 101 can slide on guide accommodating portion, on both sides of secondary transfer outside roller supporting portion 121. The engagement of guide accommodating portion 126 with the guide portion of holder 101 makes it possible for second transfer bearing 102 to vertically slide (in a direction parallel to direction in which pressure is applied to secondary transfer inside roller 62 by secondary transfer outside roller 31 while image forming apparatus 1 is in operation).

Referring to FIGS. 7, 8(*a*) and 8(*b*), second transfer bearing 102 is provided with secondary transfer bearing engaging portion 127 (engaging protrusion, claw-like portion), which is protrusive outward in terms of the thrust direction. In this embodiment, secondary transfer bearing engaging portion 127 is elastically deformable outward and inward (toward the center) in the thrust direction. Placing second transfer bearing 102 in a preset position holder 101 makes secondary transfer bearing engaging portion 127 engage with holder engaging portion 112 (engagement hole or recess) (FIG. 7) of holder 101. The secondary transfer unit 70 is structured so that secondary transfer bearing engaging portion 127 can be installed in holder 101 while being elastically deformed. Further, second transfer bearing 102 is held by holder 101 in such a state that second transfer compression spring 104 remains compressed by a certain amount. Therefore, second transfer bearing 102 does not fall out of holder 101 when right door unit 90 is opened or closed. An operator can disengage secondary transfer bearing engaging portion 127 from holder engaging portion 112 with a finger or the like to disengage second transfer bearing 102 from holder 101. Further, referring to FIGS. 7, 8(*a*) and 8(*b*), second transfer bearing 102 is provided with shaft engaging portion 128 (claw-shaped portion) which can engage the adjacencies of the end portion of axle portion 31*a*1 of secondary transfer outside roller 31, on the outward side of secondary transfer outside roller supporting portion 121 in terms of the thrust direction. In this embodiment, axle engaging portion 128 is in such a form that its sectional view looks like a letter U. It is elastically deformable in such a manner that its top end portions move toward axle portion 31*a*1 of secondary transfer outside roller 31 or the opposite direction. Axle engaging portion 128 is structured so that when secondary transfer outside roller 31 is attached to second transfer bearing 102, it is elastically deformed by an operator (axle portion 31*a*1) being thereby made to accommodate axle portion 31*a*1. Further axle engaging portion 128 is structured so that when an operator removes secondary transfer outside roller 31 from second transfer bearing 102, it is made to elastically deform by axle portion 31*a*1, making it possible for secondary transfer outside roller 31 to be pulled out of second transfer bearing 102.

Also referring to FIGS. 7, 8(*a*) and 8(*b*), second transfer bearing 102 has power supply bearing holding portion 124 for holding power supply bearing 103. Power supply bearing holding portion 124 holds power supply bearing 103 in such a manner that power supply bearing 103 is allowed to move in the upward-downward direction (direction parallel to direction in which secondary transfer outside roller 31 is pressed by power supply roller 32 while image forming apparatus 1 is in operation). Further, second transfer bearing 102 has power supply pressure bearing surface 123, which is a part of the bottom portion of power supply bearing holding portion 124, and is a part of the upwardly facing surface (toward power supply bearing 103). The top end of power supply compression spring 105 is in contact with power supply pressure bearing portion 132, which is a part of the downwardly facing surface of power supply bearing 103, which will be described later. Further the bottom end of power supply compression spring 105 is in contact with power supply pressure bearing surface 123 which is a part of second transfer bearing 102. Next, referring to FIGS. 8(*a*) and 8(*b*), the top end of power supply bearing holding portion 124 (secondary transfer outside roller 31 side) is provided with power supply bearing engaging portion 125 (engaging protrusion, claw-shaped portion), which are protrusive from both sides toward where power supply bearing 103 is. Power supply bearing holding portion 124 is elastically deformable to allow power supply bearing engaging portion 125 attached to its top end portion to move toward power supply bearing 103 or opposite direction. Attaching power supply bearing 103 to power supply bearing holding portion 124 makes the end portions of the top portion of power supply bearing 103 engage power supply bearing engaging portion 125. Second transfer bearing 102 is enabled to attach power supply bearing 103 to power supply bearing holding portion 124 while elastically deforming power supply bearing engaging portion 125 by power supply bearing 103. Further, power supply bearing 103 is held by second transfer bearing 102 in such a state that power supply compression spring 105 remains compressed by a certain amount.

Referring again to FIGS. 7, 8(*a*) and 8(*b*), power supply bearing 103 has power supply supporting portion 131 which rotatably supports axle portion 32*a*, which is a part of the end portions of power supply roller 32 in terms of the direction parallel to rotational axis of power supply roller 32. Power supply supporting portion 131 may be shaped so that it has a bearing (receiving) surface which is roughly U-shaped in cross-section, and opening side of which faces upward as shown in FIG. 8(*a*), or roughly cylindrical in cross-section (roughly cylindrical shape) as shown in FIG. 8(*b*). The downwardly facing surface of the bottom portion of power supply bearing 103 is provided with power supply pressure gearing portion 132 which bears the pressure from power supply compression spring 105. As described above, the top end of power supply compression spring 105 is in contact with power supply pressure bearing portion 132. Further, as described above, the bottom end of power supply compression spring 105 is in contact with power supply pressure bearing surface 123 with which second transfer bearing 102 is provided. Moreover, as described above, power supply bearing 103 is held by second transfer bearing 102 in such a state that power supply compression spring 105 remains compressed by a certain amount.

Here, referring to FIGS. 7, 8(*a*) and 8(*b*), in this embodiment, in terms of the thrust direction, second transfer compression spring 104 (secondary transfer pressure bearing portion 122) and power supply compression spring 105 (power supply pressure bearing portion 132) are different in position. In particular, in this embodiment, second transfer compression spring 104 is positioned on the outward side in terms of the thrust direction, and power supply compression spring 105 is positioned on the inward side (center side) in terms of the thrust direction. In this embodiment, the setting (6-8 kgf, for example) for the pressure applied to secondary transfer power supply roller 32 by secondary transfer outside roller 31 is greater than the setting (300 gf, for example) for the pressure applied to secondary transfer outside roller 31 by power supply roller 32. In such a case, in this embodiment, the length (free length) of second transfer compression spring 104 in terms of the direction in which it can be stretched or compressed is greater than that of power supply compression spring 105, although it depends on the materials therefor. Therefore, the secondary transfer unit 70 can be reduced in the size (height) in terms of the pressure application direction, by positioning second transfer compression spring 104 and power supply compression spring 105 in parallel in the thrust direction as in this embodiment.

3. Power Supply Structure

Next, referring to FIG. 7, the means for supplying power supply roller 32 with electrical power in this embodiment is described with respect to its structure.

In this embodiment, the material for holder 101 is electrically insulative resin. Also in this embodiment, the material for second transfer bearing 102 is also electrically and insulative resin. By the way, in a case where secondary transfer outside roller supporting portion 121 has bearing 121*b*, this bearing may be formed of metallic substance. Further, in this embodiment, the material for power supply bearing 103 is electrically conductive resin. Further in this embodiment second transfer compression spring 104 and power supply compression spring 105 are formed of a metallic substance (hard copper wire) which is an electrically conductive substance. Further, power supply roller 32 is a metallic roller.

Further, in this embodiment, secondary transfer unit 70 is provided with electrically conductive first and second members 106 and 107 formed of metallic wire. One end of electrically conductive first member 106 is positioned on power supply pressure bearing surface 123 of second transfer bearing 102, and the other end is positioned on power supply pressure bearing surface 123 of second transfer bearing 102. One end of electrically conductive first member 106 is in contact with the bottom end of power supply compression spring 105, and the other end is in contact with the top end of second transfer compression spring 104. Therefore, first electrically conductive member 106 keeps power supply compression spring 105 and second transfer compression spring 104 electrically in contact with each other. Further, power supply compression spring 105 is in contact with power supply bearing 103 which is electrically conductive. Therefore, it is electrically in contact with power supply roller 32 by way of power supply bearing 103. On the other hand, one end of second electrically conductive member 107 is positioned on secondary transfer pressure bearing surface 111, and the other end extends outward from holder 101. Further, one end of second electrically conductive member 107 is in contact with the bottom end of second transfer compression spring 104, and the other end is in contact with holder 101, or a contact (unshown) with which right door unit 90 is provided. Therefore, second electrically conductive member 107 keeps second transfer compression spring 104 in electrical contact with the aforementioned contact. The aforementioned contact is indirectly in contact with secondary transfer power source 81 with which apparatus main assembly 2 is provided, by way of the electrically conductive passage with which right door unit 90 and apparatus main assembly 2 are provided.

As described above, in this embodiment, electrical power is supplied to power supply roller 32 through second electrically conductive member 107, second transfer compression spring 104, first electrically conductive member 106, power supply compression spring 105, and power supply bearing 103. Making power supply compression spring 105 and second transfer compression spring 104 double as members which make up the passage through which power supply roller 32 is supplied with electric power, makes it possible not only to simplify the secondary transfer unit 70 in structure, and also, to reduce the unit in cost.

4. Assembly Steps

Next, referring to FIGS. 9 and 10, steps through which secondary transfer unit 70 is assembled is described.

Referring to FIGS. 9(*a*) and 9(*b*), for example, the steps through which secondary transfer unit 70 is reassembled after the replacement of secondary transfer outside roller 31, and/or cleaning of power supply roller 32, are as follows: First, power supply roller 32 is attached in the following manner. First, second transfer compression spring 104 is positioned on holder 101. Then, secondary transfer bearing engaging portion 127 is engaged with holder engaging portion 112. Then, power supply roller 32 is attached, with second transfer bearing 102 being held by holder 101. Referring to FIG. 9(*a*), in a case where the bearing surface of power supply supporting portion 131 of power supply bearing 103 is in such a shape that its cross section is roughly U-shaped, power supply roller 32 can be attached after power supply bearing 103 is attached to second transfer bearing 102 on which power supply bearing 103 is positioned. Further, referring to FIG. 9(*b*), in a case where the load bearing surface of power supply supporting portion 131 of power supply bearing 103 is in such a shape that its cross-section appears roughly circular, secondary transfer unit 70 has only to attached to second transfer bearing 102 on which power supply compression spring 105 is positioned, after power supply roller 32 is attached to power supply bearing 103.

Next, secondary transfer outside roller 31 is attached as shown in FIGS. 10(*a*) and 10(*b*), while second transfer bearing 102 is held by holder 101 after the attachment of power supply roller 32 as described above. Referring to FIG. 10(*a*), in a case where the load bearing surface of the secondary transfer outside roller supporting portion 121 is in such a shape that its cross-section appears roughly U-shaped, secondary transfer outside roller 31 is to be attached as if secondary transfer outside roller 31 is placed on the load bearing surface. Further, in a case where secondary transfer outside roller supporting portion 121 is provided with bearing 121*b* as shown in FIG. 10(*b*), secondary transfer outside roller 31 can be attached to bearing holding portion 121*a* after the attachment of bearing 121*b* to axle portion 31*a*1 of secondary transfer outside roller 31. During the attachment of secondary transfer outside roller 31, the adjacencies of the end of axle portion 31*a*1 of secondary transfer outside roller 31 is accepted by axle engaging portion 128, and then, is anchored by axle engaging portion 128. Thus, it becomes unlikely for secondary transfer outside roller 31 attached to second transfer bearing 102, to easily disengage from second transfer bearing 102. Further, secondary transfer power supply roller 32 attached to second transfer bearing 102 in advance is prevented from excessively protruding in the pressure application direction, by the anchoring of power supply bearing 103 by power supply bearing engaging portion 125. Therefore, the secondary transfer unit 70 can be reduced in the amount by which power supply roller 32 is compressed by secondary transfer outside roller 31 during the attachment of secondary transfer outside roller 31. Therefore, it becomes easier to attach secondary transfer outside roller 31.

By the way, while image forming apparatus 1 is in an image forming operation, secondary transfer bearing engaging portion 127, power supply bearing engaging portion 125, axle engaging portion 128 remain disengaged, enabling second transfer compression spring 104, power supply compression spring 105 to be properly compressed.

Further, secondary transfer unit 70 may be designed so that at least one of power supply roller 32 and secondary transfer outside roller 31 is attached to second transfer bearing 102 before second transfer bearing 102 is attached to holder 101.

Further, the steps for removing secondary transfer outside roller 31 and power supply roller 32 are opposite in order from the above described steps for assembling secondary transfer unit 70. Further, secondary transfer unit 70 may be designed so that secondary transfer outside roller 31 and power supply roller 32 are to be removed from second transfer bearing 102 after the removal of second transfer bearing 102 from holder 101.

Here, the present invention was described with reference to the steps to be followed to replace secondary transfer outside roller 31, and/or clean power supply roller 32, for example. However, the steps to be followed during the manufacturing of image forming apparatus 1 (secondary transfer unit 70) are the same as those described above.

As described above, in this embodiment, first bearing 102 is removably attachable to holder 101, and has first engaging portion 127 which engages with holder 101 as first bearing 102 is attached to holder 101, to regulate the movement of first bearing 102 in the pressure application direction, caused by first pressing member 104. Also in this embodiment, transfer roller 31 is removably attachable to first bearing 102, and first bearing 102 has second engaging portion 125 which engages with second bearing 103 before the attachment of transfer roller 31 to first bearing 101 to regulate second bearing 103 in its movement in the pressure direction caused by second pressing member 105. Further, in this embodiment, transfer roller 31 is removably attachable to first bearing 102, and first bearing 102 has third engaging portion 128 which can engage with transfer roller 31 when transfer roller 31 is not kept in contact with intermediary transfer belt 61, and is capable of holding transfer roller 31 held to first bearing 102, to first bearing 102.

Moreover, in this embodiment, in terms of the direction parallel to the rotational axis of transfer roller 31, where transfer roller 31 is supported by first bearing 102 and where metallic roller 32 is supported by second bearing 103 are different in position. In particular, in this embodiment, where metallic roller 32 is supported by second bearing 103 is closer to the center of transfer roller 31 in terms of the direction parallel to rotational axis of transfer roller 31 than where transfer roller 31 is supported by first bearing 102. Further, in this embodiment, in terms of the direction parallel to the rotational axis of transfer roller 31, first pressing member 104 and second pressing member 105 are different in position. In particular, in this embodiment, second pressing member 105 is closer to the center of transfer roller 31 in terms of the direction parallel to the rotational axis of transfer roller 31, than first pressing member 104. Also in this embodiment, secondary transfer unit 70 is provided with: first electrically conductive member 106 which is in contact with second pressing member 105 by one end, and first pressing member 104 by the other end; second electrically conductive member 107, one end of which is in contact with first pressing member 104, and the other end of which extends outward from holder 101. Second electrically conductive member 107, first pressing member 104, first electrically conductive member 106, second pressing member 105, and electrically conductive second bearing 103 make up an electric current path through which electric current supplied from electric power source 81 flows.

As described above, not only does this embodiment provide effects similar to those provided by the first embodiment, but also, it can simplify secondary transfer unit 70 in structure, and reduce secondary transfer unit 70 in cost. Further, it can make it easier to assemble secondary transfer unit 70.

[Miscellanies]

In the foregoing sections of the specification, the present invention was described with reference to a couple of preferred embodiments of the present invention. However, those embodiments are not intended to limit the present invention in scope.

Figure 11:
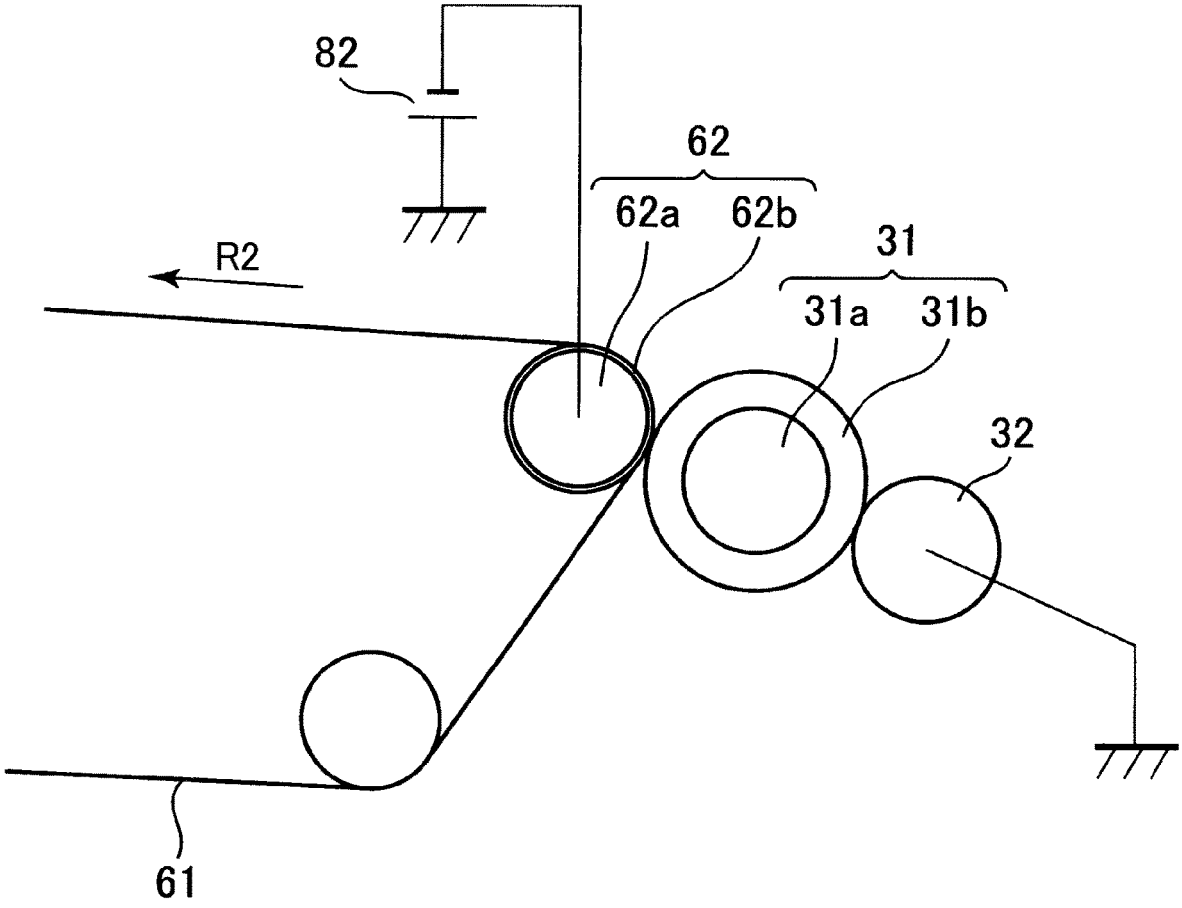
FIG. 11 is a schematic sectional view of another secondary transferring section of an image forming apparatus for describing how the secondary transfer section is supplied with electric power.

In the embodiments of the present invention described above, the secondary transfer voltage was applied to secondary transfer portion N2 from power supply roller 32 by way of secondary transfer outside roller 31. However, the secondary transfer voltage may be applied to secondary transfer portion N2 in the following manner. By the way, the elements which are the same as, or correspondent in function to, those in the first embodiment described above are given the same referential codes as those given to the counterparts in the first embodiment. FIG. 11 is a schematic drawing of one of the other examples of how to supply secondary transfer portion N2 with electric power. Secondary transfer inside roller 62 is in contact with secondary transfer electric power source 82 (high voltage electric power source circuit). Secondary transfer power source 82 applies to metallic core 62*a* of secondary transfer inward roller 62, the secondary transfer voltage (secondary transfer bias), which is DC voltage and is same in polarity (negative in this embodiment) as the normal toner polarity, during the secondary transfer process. In this embodiment, the voltage to be applied to secondary transfer inside roller 62 by secondary transfer electric power source 82 is controlled so that it remains stable in voltage. On the other hand, metallic core 31*a* of secondary transfer outside roller 31 is kept floating electrically. Further, the peripheral surface of secondary transfer outside roller 31 is kept in contact with metallic roller 32. Further, in this embodiment, metallic roller 32 is positioned in the adjacencies of where it opposes secondary transfer inside roller 62 with the presence of secondary transfer outside roller 31 between metallic roller 32 and secondary transfer inside roller 62. Metallic roller 32 is grounded (connected to ground). During the secondary transfer, it occurs in secondary transfer portion N2 that electrically conductive agent which is positive in polarity collects in the outward portion of elastic layer 31*b* in terms of the radius direction of secondary transfer outside roller 31, and the electrically conductive agent which is minus in polarity collects in the inward portion of elastic layer 31*b*. On the other hand, it occurs in the interface N3 between metallic roller 32 and secondary transfer outside roller 31 that electric current flows in the direction to mitigate the polarization of the electrically conductive agent in secondary transfer outside roller 31, which occurred during the secondary transfer (direction to cancel the localization of electrically conductive agent in secondary transfer outside roller 31). By the way, in this embodiment, an electrical voltage source which is stable in voltage was used as secondary transfer electric power source 82. However, the present is also compatible with an image forming apparatus which employs a voltage source which is stable in electrical current.

Further, in the embodiments described above, the present invention was applied to the secondary transferring portion of a color image forming apparatus of the intermediary transfer type. However, the present invention is also applicable to the transferring portion of a monochromatic image forming apparatus, for example. In such a case, the portion of image forming apparatus 1, which is for supporting the transfer roller which contacts the photosensitive member as an image bearing member, and the power supply roller which contacts a transfer roller, may be made similar in structure as that in the embodiments described above. Such an application of the present invention can offer effects similar to those obtainable by the embodiments described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-132716 filed on Aug. 4, 2020, which is hereby incorporated by reference herein in its entirety.

What is claimed is:

1. An image forming apparatus comprising:

an image bearing member configured to bear a toner image;

an intermediary transfer belt onto which the toner image formed on said image bearing member is transferred;

a transfer roller configured to be rotated with rotation of said intermediary transfer belt in contact with an outer peripheral surface of said intermediary transfer belt, and to form a transfer portion to transfer the toner image borne on said intermediary transfer belt;

a metallic roller in contact with said transfer roller, configured to be rotated by rotation of said transfer roller and to form a current path through which a current flows between said metallic roller and said transfer roller;

a first bearing member configured to rotatably support said transfer roller;

a holding member configured to movably hold said first bearing member;

a first pressing member configured to press said first bearing member;

a second bearing member movably held by said first bearing member and configured to rotatably support said metallic roller; and a second pressing member provided between a bearing surface provided in said first bearing member and said second bearing member, configured to press said second bearing member.

2. An image forming apparatus according to claim 1, wherein said first pressing member presses said first bearing member so as to urge said transfer roller toward an opposing roller opposite to said transfer roller through said intermediary transfer belt, and wherein a setting of a pressing force by said first pressing member to said transfer roller is greater than a setting of a pressing force by said second pressing member to said metallic roller.

3. An image forming apparatus according to claim 1, wherein an electric path is formed to supply electric power to said metallic roller through said first pressing member and said second pressing member.

4. An image forming apparatus according to claim 3, further comprising:

a first conductive member of which one end is contact with said second pressing member and the other end is contact with said first pressing member, and a second conductive member of which one end is contact with said first pressing member and the other end extends outward from said holding member, wherein said electric path supplying the electric power to said metallic roller is formed through said second conductive member, said first pressing member, said first conductive member, said second pressing member and said second bearing member having conductivity.

5. An image forming apparatus according to claim 1, wherein said transfer roller is provided with a metallic core and an elastic layer formed around said metallic core.

6. An image forming apparatus according to claim 1, wherein said first bearing member is detachably mountable to said holding member, and provided with an engaging portion configured to restrict movement of said first bearing member with respect to a pressing direction of said first pressing member by engaging with said holding member when said first bearing member is mounted to said holding member.

7. An image forming apparatus according to claim 1, wherein said transfer roller is detachably mounted to said first bearing member, and provided with an engaging portion configured to restrict movement of said second bearing member with respect to a pressing direction of said second pressing member by engaging with said second bearing member when said transfer roller is not mounted to said first bearing member.

8. An image forming apparatus according to claim 1, wherein said transfer roller is detachably mountable to said first bearing member, and provided with an engaging portion capable of engaging with said transfer roller and capable of holding said transfer roller mounted to said first bearing member in said first bearing member when said transfer roller is not contact with said intermediary transfer belt.

9. An image forming apparatus according to claim 1, wherein said second pressing member is positioned closer to a central region of said transfer roller than said first pressing member is to the central region of said transfer roller with respect to a rotational axial direction of said transfer roller.

* * * * *